US010976078B2

(12) United States Patent
Kniffler et al.

(10) Patent No.: US 10,976,078 B2
(45) Date of Patent: Apr. 13, 2021

(54) HEAT PUMP SYSTEM COMPRISING TWO STAGES, METHOD OF OPERATING A HEAT PUMP SYSTEM AND METHOD OF PRODUCING A HEAT PUMP SYSTEM

(71) Applicant: Efficient Energy GmbH, Feldkirchen (DE)

(72) Inventors: Oliver Kniffler, Sauerlach (DE); Holger Sedlak, Sauerlach (DE); Florian Hanslik, Munich (DE); Thaddäus Hinterberger, Wasserburg am Inn (DE)

(73) Assignee: EFFICIENT ENERGY GMBH, Feldkirchen (DE)

( * ) Notice: Subject to any disclaimer, the term of this patent is extended or adjusted under 35 U.S.C. 154(b) by 150 days.

(21) Appl. No.: 16/128,702

(22) Filed: Sep. 12, 2018

(65) Prior Publication Data

US 2019/0011152 A1 Jan. 10, 2019

Related U.S. Application Data

(63) Continuation of application No. PCT/EP2017/055729, filed on Mar. 10, 2017.

(30) Foreign Application Priority Data

Mar. 14, 2016 (DE) ..... 102016204158.4

(51) Int. Cl.
*F25B 7/00* (2006.01)
*F25B 30/02* (2006.01)
(Continued)

(52) U.S. Cl.
CPC ..... *F25B 7/00* (2013.01); *F25B 30/02* (2013.01); *F25B 39/00* (2013.01); *F25B 25/005* (2013.01);
(Continued)

(58) Field of Classification Search
CPC ..... F25B 13/00; F25B 7/00; F25B 2313/005; F25B 2313/023; F25B 2400/06; F25B 2400/22
See application file for complete search history.

(56) References Cited

U.S. PATENT DOCUMENTS 4,324,983 A 4/1982 Humiston
5,520,008 A 5/1996 Ophir et al.
(Continued)

FOREIGN PATENT DOCUMENTS

CN 104428610 A 3/2015
CN 105264306 A 1/2016
(Continued)

OTHER PUBLICATIONS

International Search Report and Written Opinion for PCT/EP2017/055729 dated May 19, 2017.
(Continued)

*Primary Examiner* — Elizabeth J Martin
(74) *Attorney, Agent, or Firm* — McClure, Qualey & Rodack, LLP

(57) ABSTRACT

A heat pump system includes a heat pump stage having a first evaporator, a first liquefier, and a first compressor; and a further heat pump stage having a second evaporator, a second liquefier, and a second compressor, wherein a first liquefier exit of the first liquefier is connected to a second evaporator entrance of the second evaporator via a connecting lead.

25 Claims, 16 Drawing Sheets

(51) Int. Cl.

| | |
|---|---|
| ***F25B 39/00*** | (2006.01) |
| ***F25B 41/00*** | (2021.01) |
| ***F25B 25/00*** | (2006.01) |
| ***F25B 41/04*** | (2006.01) |
| ***F25B 39/02*** | (2006.01) |
| ***F25B 39/04*** | (2006.01) |

(52) U.S. Cl.

CPC ..... *F25B 39/02* (2013.01); *F25B 39/04* (2013.01); *F25B 41/003* (2013.01); *F25B 41/04* (2013.01); *F25B 2339/047* (2013.01)

(56) References Cited

U.S. PATENT DOCUMENTS

| | | | | |
|---|---|---|---|---|
| 6,298,683 | B1 * | 10/2001 | Kondo | F25B 7/00 62/335 |
| 2004/0050093 | A1 | 3/2004 | Lifson et al. | |
| 2007/0245759 | A1 | 10/2007 | Sedlak et al. | |
| 2015/0034580 | A1 | 2/2015 | Hofvander | |
| 2015/0068228 | A1 | 3/2015 | Sedlak et al. | |
| 2016/0138837 | A1 | 5/2016 | Gromoll et al. | |

FOREIGN PATENT DOCUMENTS

| | | | |
|---|---|---|---|
| DE | 28 46 797 | A1 | 5/1979 |
| DE | 44 318 87 | A1 | 3/1995 |
| DE | 20 2006 009 538 | U1 | 10/2006 |
| DE | 10 2009 052 559 | A1 | 5/2011 |
| DE | 10 2012 208 174 | A1 | 11/2013 |
| DE | 10 2012 112 347 | A1 | 6/2014 |
| EP | 1059494 | A1 | 12/2000 |
| EP | 2016349 | B1 | 1/2009 |
| EP | 2330367 | A2 | 6/2011 |
| WO | 00/39510 | A1 | 7/2000 |
| WO | 2014/072239 | A1 | 5/2014 |

OTHER PUBLICATIONS

Chinese Office Action dated May 11, 2020, issued in application No. 201780029340.9.

German Office Action dated May 11, 2020, issued in application No. 201780029340.9.

* cited by examiner

| | mode | connections | | |
|---|---|---|---|---|
| 451 | HPM | 401-411 | 402-413 | 403-412 |
| 452 | MPM | 401-411 | 402-412 | 403-413 |
| 453 | FCM | 401-412 | 402-411 | 403-413 |
| 454 | LPM | 401-413 | 402-411 | 403-412 |

| mode | compr. 1 | compr. 2 | PZ | PV | PK |
|---|---|---|---|---|---|
| HPM | on | on | on | on | on |
| MPM | on | off | on | on | on |
| FCM | on | off | on | on | on |
| LPM | off | off | off | on | on |

Fig. 7A

| mode | upper 2x2 | lower 2x2 |
|---|---|---|
| HPM | / | \ |
| MPM | / | / |
| FCM | \ | / |
| LPM | \ | \ |

Fig. 7B

| temperature of the area to be heated | exemplary temperature | mode of operation ("coarse control") |
|---|---|---|
| very cold | $t \leq 16°C$ | 1st mode of operation (LPM)<br>HP is bridged<br>(control for area to be heated) |
| medium cold | $16°C \leq t \leq 22°C$ | free-cooling mode (FCM)<br>1st stage operates at low power |
| warm | $22°C \leq t \leq 28°C$ | normal mode (MPM)<br>of the 1st stage |
| very warm | $28°C \leq t \leq 40°C$ | second stage is activated<br>(HPM) |

"fine control"
by speed adjustment
of the centrifugal
compressor

Fig. 7C

| $T_{liquef.}$ | reaction | $T_{compr.}$ | reaction |
|---|---|---|---|
| very cold | 1st mode of operation (LPM) | $< T_{target}$ | reduction of heat dissipation |
| medium cold | free-cooling mode (FCM) | $> T_{target}$ | increase in speed of centrifugal compressor |
| warm | 1st stage (MPM) | $> T_{target}$ | increase in speed of 1st stage |
| very warm | 1st stage + 2nd stage (HPM) | $\gtrless T_{target}$ | control of 1st stage and 2nd stage |

Fig. 7D

| P[hPa] | 8 | 12 | 30 | 60 | 100 | 1000 |
|---|---|---|---|---|---|---|
| compr. temp. | 4°C | 12°C | 24°C | 36°C | 45°C | 100°C |

HEAT PUMP SYSTEM COMPRISING TWO STAGES, METHOD OF OPERATING A HEAT PUMP SYSTEM AND METHOD OF PRODUCING A HEAT PUMP SYSTEM

CROSS-REFERENCES TO RELATED APPLICATIONS

This application is a continuation of copending International Application No. PCT/EP2017/055729, filed Mar. 10, 2017, which is incorporated herein by reference in its entirety, and additionally claims priority from German Application No. DE 102016204158.4, filed Mar. 14, 2016, which is incorporated herein by reference in its entirety.

The present invention relates to heat pumps for heating, cooling or for any other application of a heat pump.

BACKGROUND OF THE INVENTION

FIG. 8A and FIG. 8B provide a heat pump as is described in European Patent EP 2016349 B1. The heat pump initially includes an evaporator 10 for evaporating water as a working liquid so as to generate vapor within a working vapor line 12 on the output, or exit, side. The evaporator includes an evaporation space (evaporation chamber) (not shown in FIG. 8A) and is configured to generate an evaporation pressure smaller than 20 hPa within said evaporation space, so that at temperatures below 15° C. within the evaporation space, the water will evaporate. The water is, e.g., ground water, brine, i.e. water having a certain salt content, which freely circulates in the earth or within collector pipes, river water, lake water or sea water. Any types of water, i.e. limy water, lime-free water, salty water or salt-free water, may be used. This is due to the fact that any types of water, i.e. all of said "water materials" have the favorable water property that water, which is also known as "R 718", has an enthalpy difference ratio of 6 that can be used for the heat pump process, which corresponds to more than double the typical enthalpy difference ratio of, e.g., R134a.

Through the suction line 12, the water vapor is fed to a compressor/condenser system 14 comprising a fluid flow Machine (turbo-machine) such as a centrifugal compressor, for example in the form of a turbocompressor, which is designated by 16 in FIG. 8A. The fluid flow machine is configured to compress the working vapor to a vapor pressure at least larger than 25 hPa. 25 hPa corresponds to a condensation temperature of about 22° C. which may already be a sufficient heating flow temperature of an underfloor heating system. In order to generate higher flow temperatures, pressures larger than 30 hPa may be generated by means of the fluid flow machine 16, a pressure of 30 hPa having a condensation temperature of 24° C., a pressure of 60 hPa having a condensation temperature of 36° C., and a pressure of 130 hPa having a condensation temperature of 45° C. Underfloor heating systems are designed to be able to provide sufficient heating with a flow temperature of 45° C. even on very cold days.

The fluid flow machine is coupled to a condenser 18 configured to condense the compressed working vapor. By means of the condensing process, the energy contained within the working vapor is fed to the condenser 18 so as to then be fed to a heating system via the advance 20*a*. Via the backflow 20*b*, the working liquid flows back into the condenser.

In accordance with the invention, it is advantageous to directly withdraw the heat (energy), which is absorbed by the heating circuit water, from the high-energy water vapor by means of the colder heating circuit water, so that said heating circuit water heats up. In the process, a sufficient amount of energy is withdrawn from the vapor so that said stream is condensed and also is part of the heating circuit.

Thus, introduction of material into the condenser and/or the heating system takes place which is regulated by a drain 22 such that the condenser in its condenser space has a water level which usually remains below a maximum level despite the continuous supply of water vapor and, thus, of condensate.

As was already explained, it is advantageous to use an open circuit, i.e. to evaporate the water, which represents the heat source, directly without using a heat exchanger. However, alternatively, the water to be evaporated might also be initially heated up by an external heat source via a heat exchanger. In addition, in order to also avoid losses for the second heat exchanger, which has expediently been present on the condenser side, the medium can also used directly, and for example when one thinks of a house comprising an underfloor heating system, the water coming from the evaporator can be allowed to directly circulate within the underfloor heating system.

Alternatively, however, a heat exchanger supplied by the advance 20*a* and exhibiting the backflow 20*b* may also be arranged on the condenser side, said heat exchanger cooling the water present within the condenser and thus heating up a separate underfloor heating liquid, which typically will be water.

Due to the fact that water is used as the working medium and due to the fact that only that portion of the ground water that has been evaporated is fed into the fluid flow machine, the degree of purity of the water does not make any difference. Just like the condenser and the underfloor heating system, which is possibly directly coupled, the fluid flow machine is supplied with distilled water, so that the system has reduced maintenance requirements as compared to today's systems. In other words, the system is self-cleaning since the system only ever has distilled water supplied to it and since the water within the drain 22 is thus not contaminated.

In addition, it shall be noted that fluid flow machines exhibit the property that they—similar to the turbine of a plane—do not bring the compressed medium into contact with problematic substances such as oil, for example. Instead, the water vapor is merely compressed by the turbine and/or the turbocompressor, but is not brought into contact with oil or any other medium impairing purity, and is thus not soiled.

The distilled water discharged through the drain thus can readily be re-fed to the ground water—if this does not conflict with any other regulations. Alternatively, it can also be made to seep away, e.g. in the garden or in an open space, or it can be fed to a sewage plant via the sewer system if this is called for by regulations.

Due to the combination of water as the working medium with the enthalpy difference ratio, the usability of which is double that of R134a, and due to the thus reduced requirements placed upon the closed nature of the system and due to the utilization of the fluid flow machine, by means of which the compression factors that may be used are efficiently achieved without any impairments in terms of purity, an efficient and environmentally neutral heat pump process is provided.

FIG. 8B shows a table for illustrating various pressures and the evaporation temperatures associated with said pressures, which results in that relatively low pressures are to be selected within the evaporator in particular for water as the working medium.

DE 4431887 A1 discloses a heat pump system comprising a light-weight, large-volume high-performance centrifugal compressor. Vapor which leaves a compressor of a second stage exhibits a saturation temperature which exceeds the ambient temperature or the temperature of cooling water that is available, whereby heat dissipation is enabled. The compressed vapor is transferred from the compressor of the second stage into the condenser unit, which consists of a granular bed provided inside a cooling-water spraying means on an upper side supplied by a water circulation pump. The compressed water vapor rises within the condenser through the granular bed, where it enters into a direct counter flow contact with the cooling water flowing downward. The vapor condenses, and the latent heat of the condensation that is absorbed by the cooling water is discharged to the atmosphere via the condensate and the cooling water, which are removed from the system together. The condenser is continually flushed, via a conduit, with non-condensable gases by means of a vacuum pump.

WO 2014072239 A1 discloses a condenser having a condensation zone for condensing vapor, that is to be condensed, within a working liquid. The condensation zone is configured as a volume zone and has a lateral boundary between the upper end of the condensation zone and the lower end. Moreover, the condenser includes a vapor introduction zone extending along the lateral end of the condensation zone and being configured to laterally supply vapor that is to be condensed into the condensation zone via the lateral boundary. Thus, actual condensation is made into volume condensation without increasing the volume of the condenser since the vapor to be condensed is introduced not only head-on from one side into a condensation volume and/or into the condensation zone, but is introduced laterally and, advantageously, from all sides. This not only ensures that the condensation volume made available is increased, given identical external dimensions, as compared to direct counterflow condensation, but that the efficiency of the condenser is also improved at the same time since the vapor to be condensed that is present within the condensation zone has a flow direction that is transverse to the flow direction of the condensation liquid.

In the case of heat pump systems, in particular when heat pump systems are to be used for heating or cooling, it is disadvantageous, for example, but not exclusively, within the low- to medium-performance ranges, for the heat pump systems to operate unreliably and/or to be very bulky. Such problems may occur when the working liquid is kept at a relatively low pressure, for example, as is the case when water is being used as the working liquid, for example. In this case it is to be ensured, in particular when using pumps, that the pressure prevailing within the working liquid does not become too low on the suction side of the pump. If this were to happen, specifically, the activity of the pump, namely when the pump wheel (impeller) supplies the liquid with energy, would result in bubbles occurring in the liquid. Said bubbles will then implode. Said process is referred to as "cavitation". Whenever cavitation takes place at all and/or with a specific intensity, this may result in damage to the pump wheels and, therefore, to a reduced service life of the heat pump system in the long run. In addition, a pump wheel that has already been damaged but is still running results in the pump efficiency to decrease. If said decreasing efficiency of the pump is balanced off by increased pumping power, this will result in a level of energy consumption that is not necessary, in principle, and, therefore, to reduced efficiency of the heat pump system. However, if the pumping power is not compensated for, a pump which has already been damaged by excessive cavitation but is still operational will result in that the pumping volume delivered decreases, which will also result in reduced efficiency of the heat pump system.

Further aspects of a heat pump system comprising heat exchangers consist in the manner in which the heat pump system may be put into operation; for a first start-up or for start-up following a servicing stop, the heat exchangers are to be filled up. In principle, one heat exchanger is provided on the cold-water side, and one heat exchanger is provided on the warm-water or cooling-water side. Said heat exchangers, which are typically very heavy, are to be favorably connected to pumps and heat pump stages, and additionally should be easy to service and, in particular, should be installed such that initial start-up or turning-off of the heat pump system should be as easy as possible and, thus, should take place in as reliable and easily maintainable a manner as possible.

A further point that plays an important part is utilization of several heat pump stages within one heat pump system, and coupling of the heat pump stages to one another or to various pumps or various heat exchangers so as to provide an optimum heat pump system which operates efficiently, has a long service life or is flexibly employable for various operation conditions.

SUMMARY

According to an embodiment, a heat pump system may have: a heat pump stage having a first evaporator, a first liquefier, and a first compressor; and a further heat pump stage having a second evaporator, a second liquefier, and a second compressor, wherein a first liquefier exit of the first liquefier is connected to an evaporator entrance of the second evaporator via a connecting lead, so that during operation of the heat pump system, working liquid from the first liquefier of the heat pump stage may enter into the second evaporator of the further heat pump stage via the connecting lead and may evaporate within the second evaporator of the further heat pump stage.

According to another embodiment, a method of producing a heat pump system including a heat pump stage having a first evaporator, a first liquefier, and a first compressor, and a further heat pump stage having a second evaporator; a second liquefier, and a second compressor may have the step of: connecting a first liquefier exit of the first liquefier is connected to an evaporator entrance of the second evaporator, so that during operation of the heat pump system, working liquid from the first liquefier of the heat pump stage may enter into the second evaporator of the further heat pump stage via the connecting lead and may evaporate within the second evaporator of the further heat pump stage.

According to another embodiment, a method of operating a heat pump system including a heat pump stage having a first evaporator, a first liquefier, and a first compressor, and a further heat pump stage having a second evaporator, a second liquefier, and a second compressor, wherein a first liquefier exit of the first liquefier is connected to an evaporator entrance of the second evaporator via a connecting lead may have the step of: directing a working liquid from the first liquefier exit of the first liquefier to the evaporator entrance of the second evaporator through the connecting lead, so that during operation of the heat pump system, working liquid from the first liquefier of the heat pump stage may enter into the second evaporator of the further heat pump stage via the connecting lead and may evaporate within the second evaporator of the further heat pump stage.

In one aspect of the present invention, the heat exchangers are arranged at the bottom of the heat pump system, specifically below the pumps. Such a heat pump system includes a heat pump unit comprising at least one, and advantageously several, heat pump stage(s). In addition, a first heat exchanger is provided on a side to be cooled. Moreover, a second heat exchanger is provided on a side to be heated. Furthermore, there are a first pump coupled to the first heat exchanger, and a second pump coupled to the second heat exchanger. The heat pump system has an operating position wherein the first pump and the second pump are arranged above the first and second heat exchangers. Moreover, the heat pump unit comprising the one or several heat pump stages is arranged above the first and second pumps.

An advantage of said arrangement in accordance with an aspect of the invention is the low center of gravity. Typically, the heat exchangers are the heaviest units. In the embodiment, the pump module is arranged above the heat exchangers; when several heat pump stages are used, a mixer module is possibly arranged, again, above the pump module. The one or more containers comprising the one or more compressors of the heat pump stages are disposed at the highest point. A particular advantage of arranging the compressors at the highest point consists in that they will be dry in the off state since, specifically, the working liquid such as water, for example, will flow off in the downward direction due to gravity.

Said arrangement wherein the heat exchangers are provided at the bottom is characterized by a light design. Initially, the heat exchangers are mounted, e.g., in a heat pump system rack. Then the pump module, possibly the mixer and/or way module and, eventually, the one or more heat pump stages are placed thereon. Advantageously, the heat exchangers are arranged in a lying position here. This results in that when the heat pump system is filled up during initial start-up or during start-up following a maintenance interval, no air inclusions take place, i.e. that the heat pump system is pelf-venting.

In addition, it is advantageous in this embodiment for all of the pumps to be arranged in downpipes rather than in riser pipes. In particular, the pumps are arranged such that the Suction side of the pump is arranged as far down as possible within the downpipe. Thus, kinetic energy is obtained due to very the height of fall of the column of water, and the pressure exerted on the suction side of the pump is higher than in a riser pipe extending from the bottom upward. Thus, the minimum column of water on the suction side of the pump will be smaller than called for by the manufacturer of the pump. Thus, for one thing, cavitation or excessive cavitation may be prevented. For another thing, what is achieved is a compact heat pump system which does not occupy a particularly large amount of space for its application. This is due to the fact that the pipe connections may be designed to be short in front of the suction side of the pump. Thus, the entire system: becomes more compact and, therefore, less bulky. A more compact design may also result in savings in weight.

In a second aspect of the present invention, the heat pump system is provided with pumps arranged at the very bottom. As an alternative to the first aspect described, therefore, in accordance with the second aspect of the present invention, the first and second pumps are arranged, in the operating position, below the heat pump unit at a lower end of the heat pump system. In addition, in this arrangement, the first heat exchanger and the second heat exchanger are also arranged, in the operating position, below the heat pump unit, at the lower end next to the pumps. So as to therefore efficiently prevent cavitation, the pumps are arranged at the lowest point of the heat pump system. Moreover, the pumps are installed horizontally, so that the maximum dynamic pressure prevails in front of the suction Side of the pump. Thus, cavitation and, consequently, damaging of the impellers (pump wheels), is efficiently avoided. The dynamic pressure that may be used in front of the suction side of the pump determines the smallest difference in height possible between the heat pump stage, i.e. the container including the liquefier, the evaporator and the compressor, and the corresponding pump. Advantageously, the heat exchanger is mounted in an upright position in the second aspect so that air cavities are prevented from occurring during filling. Moreover, due to the upright position of the heat exchangers, the pipe connection that may be used from the heat exchanger back into the evaporator, and/or into the liquefier, becomes shorter since the heat exchanger itself, which typically may have a considerable length, is made additional use of, as it were, as a connecting lead.

In a third aspect of the present invention, the heat pump system is operated not only by means of one single heat pump stage, but by means of two or more heat pump stages. Here, the heat pump stage comprising a first compressor, a first liquefier and a first evaporator is cascaded, as it were, with a second, or further, heat pump stage comprising a second compressor, a second liquefier and a second evaporator. To this end, the first liquefier exit of the first liquefier is connected to a second evaporator entrance of the second evaporator of the further heat pump stage via a connecting lead. Thus, the warmest liquid of the heat pump stage is led into the evaporator, i.e. into the coldest area of the further heat pump stage, so as to be cooled again there. Thus, the heat pump stages are not connected in parallel but are cascaded. Depending on the implementation, the input, or entrance, of the liquefier of the first heat pump stage may be coupled to the output of the evaporator of the further heat pump stage, or, as is advantageous in specific embodiments, may be led into a controllable way module so as to operate the heat pump system comprising the heat pump stage and the further heat pump stage in various operating modes which are optimally adapted to the heating and/or cooling task.

In advantageous embodiments of the third aspect of the present invention, which refers to the cascade connection of two heat pump stages, the first liquefier of the heat pump stage is operated, in the operating position, above the second evaporator of the further heat pump stage, so that the working liquid flows from the first liquefier into the second evaporator within the connecting lead on account of gravity. Thus, one pump may be saved here. Only one intermediate-circuit pump may be used for bringing working liquid from the evaporator of the further heat pump stage back up to a higher level with regard to the operating position into the liquefier of the heat pump stage, i.e. of the first heat pump stage. Thus, a heat pump system comprising two heat pump stages may be efficiently operated with merely three pumps, namely a first pump coupled to the entrance into the cold-side heat exchanger, a second pump coupled to the entrance into the warm-side heat exchanger, and an intermediate-circuit pump coupled to the exit of the evaporator of the further heat pump stage.

Arranging further heat pump stages may also take place as a cascade connection, where it is possible, when the respective liquefiers of the lower heat pump stage are arranged above the respective evaporator of the higher heat pump stage, to save pumps here again as well. Alternatively or additionally, the third stage or further stages may also be coupled in parallel or in series or in any other manner to the two cascaded heat pumps.

The space that results below the heat pump stage arranged at a higher level is advantageously used for accommodating a way module which is controllable to implement different operating modes. Various operating modes include a high-performance mode, a Medium-performance mode, a free-cooling mode, or a low-performance mode; in accordance with the third aspect of the present invention, a controller is provided for setting the controllable way module such that at least two of said four operating modes are implemented. In other embodiments, three, and in yet other embodiments, all four of the operating modes are implemented. By using a larger number of heat pump stages, further operating modes, i.e. more than four operating modes, may be implemented.

Due to the arrangement of the pumps and of the heat exchangers in accordance with the first or second aspects, one achieves almost only straight point-to-point connections, which are favorable for a compact design and for avoidance of cavitation.

Due to the difference in height of the two containers, one may dispense with, as has been set forth, arranging a pump between the liquefier exit of the higher container and the evaporator entrance of the lower container. The space that arises due to the height difference of the two containers is used for the controllable way switch by means of which the heat pump system may be switched to different modes so as to achieve optimum adaptation to various operating conditions.

The arrangement of the two heat pump stages and the wiring of the heat pump stages in accordance with a cascade connection, i.e. by connecting the liquefier exit of the liquefier of the first stage to the evaporator entrance of the evaporator of the further stage, enables the already existing infrastructure to be employed in each operating mode. Thus, both heat pump stages have working liquid flowing through them irrespectively of whether or not they are active, i.e. of whether or not the respective compressor is in operation. Consequently, no bypass lines or valves are needed. Instead, the ways are switched within a 2×2-way switch array in order to switch from one operating mode to another operating mode.

This enables putting into operation an inactive heat pump stage, i.e. a heat pump stage wherein the compressor is not active, i.e. wherein the same pressure prevails on the evaporator and liquefier sides, without taking any further measures by starting the compressor. Thus, the system is configured such that no specific start-up or evacuation measures may be used for this purpose, but a heat pump stage is started when the compressor is put into operation, and is stopped when the compressor is put out of operation. Nevertheless, the intakes for the evaporator and the liquefier, and the drains from the evaporator and the liquefier of one stage will still have liquid flowing through them despite the compressor being deactivated. This ensures an optimum stand-by mode without involving specific energy consumption for said purpose.

In a further embodiment, an efficient working liquid transport device is employed. It has turned out that working liquid accumulates within the evaporator of the lower stage, i.e. of that stage which is thermodynamically arranged on the side to be heated. In order to enable equalization in relation to the evaporator present within the container located at a higher level, a self-regulating system, which may have an overflow and a U pipe, for example, is employed. The U pipe is connected to a bottleneck in front of a pump within the evaporator circuit of the higher container. Due to the increased flow velocity that prevails in front of the pump, the pressure decreases, and water from the U pipe can be received. The system is self-regulating in that a stable water level is established within the U pipe, which suffices the pressure prevailing in front of the pump, within the bottleneck and within the evaporator of the lower container.

BRIEF DESCRIPTION OF THE DRAWINGS

Embodiments of the present invention will be detailed subsequently referring to the appended drawings, in which:

FIG. 7A shows a table for depicting the operating conditions of various components in the different modes of operation;

FIG. 7B shows a table for depicting the operating conditions of the two coupled controllable 2×2-way switches;

FIG. 7C shows a table for depicting the temperature ranges for which the modes of operation are suitable;

FIG. 7D shows a schematic representation of the coarse/fine control over the modes of operation, on the one hand, and the speed control, on the other hand;

DETAILED DESCRIPTION OF THE INVENTION

Figure 1:
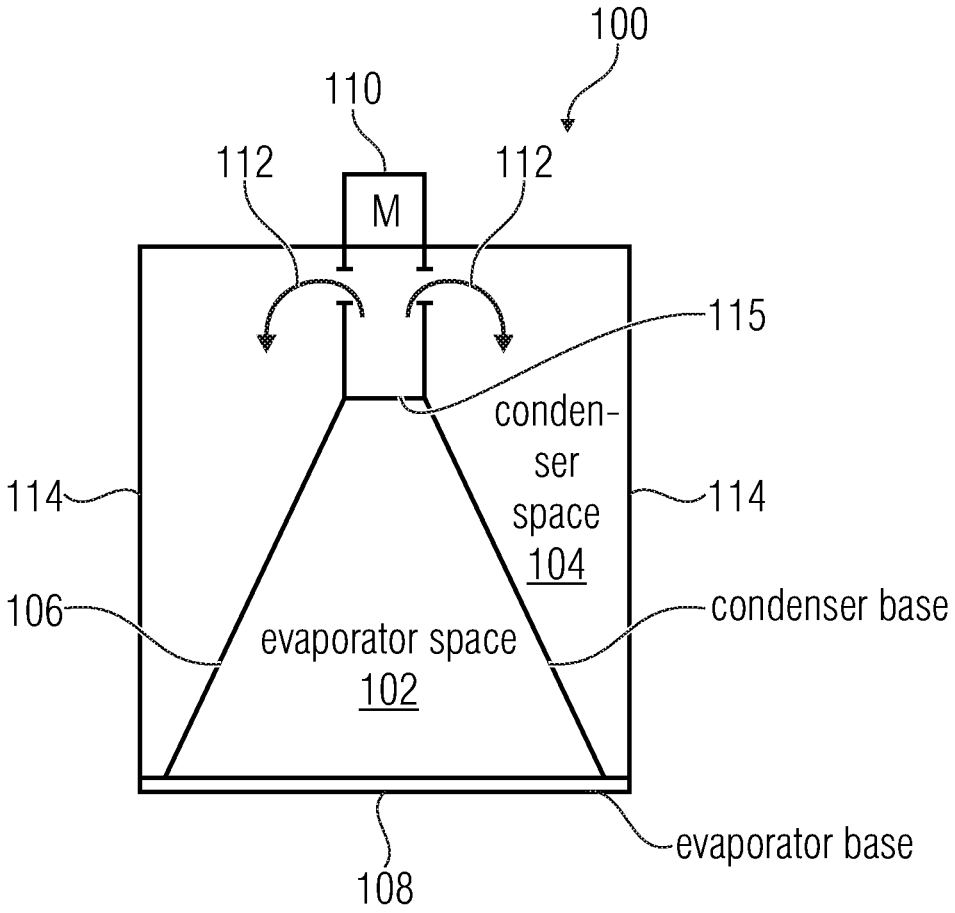
FIG. 1 shows a schematic diagram of a heat pump stage having an interleaved evaporator/condenser arrangement.

FIG. 1 shows a heat pump 100 comprising an evaporator for evaporating working liquid within an evaporator space 102. The heat pump further includes a condenser for condensing evaporated working liquid within a condenser space 104 bounded by a condenser base 106. As shown in FIG. 1, which can be regarded both as a sectional representation and as a side view, the evaporator space 102 is at least partially surrounded by the condenser space 104. Moreover, the evaporator space 102 is separated from the condenser space 104 by the condenser base 106. In addition, the condenser base is connected to an evaporator base 108 so as to define the evaporator space 102. In one implementation, a compressor 110 is provided above the evaporator space 102 or at a different location, said compressor 110 not being explained in detail in FIG. 1 but being configured, in principle, to compress evaporated working liquid and to direct same into the condenser space 104 as compressed vapor 112. Moreover, the condenser space is bounded toward the outside by a condenser wall 114. The condenser wall 114 is also attached to the evaporator base 108, as is the condenser base 106. In particular, the dimensioning of the condenser base 106 in the area forming the interface with the evaporator base 108 is such that in the embodiment shown in FIG. 1, the condenser base is fully surrounded by the condenser space wall 114. This means that the condenser space extends right up to the evaporator base, as shown in FIG. 1, and that the evaporator base simultaneously extends very far upward, typically almost through the entire condenser space 104.

This "interleaved" or intermeshing arrangement of the condenser and the evaporator, which arrangement is characterized in that the condenser base is connected to the evaporator base, provides a particularly high level of heat pump efficiency and therefore enables a particularly compact design of a heat pump. In terms of order of magnitude, dimensioning of the heat pump, e.g., in a cylindrical shape, is such that the condenser wall 114 represents a cylinder having a diameter of between 30 and 90 cm and a height of between 40 and 100 cm. However, the dimensioning can be selected as a function of the power class of the heat pump that may be used, but will advantageously range within the dimensions mentioned. Thus, a very compact design is achieved which additionally is easy to produce at low cost since the number of interfaces, in particular for the evaporator space subjected to almost a vacuum, can be readily reduced when the evaporator base in accordance with advantageous embodiments of the present invention is configured such that it includes all of the liquid feed inlets/discharge, outlets and such that, as a result, no liquid feed inlets/discharge outlets from the side or from the top are required.

In addition, it shall be noted that the operating direction of the heat pump is as shown in FIG. 1. This means that during operation, the evaporator base defines the lower portion of the heat pump, however, apart from lines connecting it to other heat pumps or to corresponding pump units. This means that during operation, the vapor produced within the evaporator space rises upward and is redirected by the motor and is fed into the condenser space from top to bottom, and that the condenser liquid is directed from bottom to top and is then supplied to the condenser space from the top and then flows from top to bottom within the condenser space such as by means of individual droplets or by means of small liquid streams so as to react with the compressed vapor, which advantageously is supplied in a transverse direction, for the purposes of condensation.

This arrangement, which is mutually "interleaved" in that the evaporator is almost entirely or even entirely arranged within the condenser, enables very efficient implementation of the heat pump with optimum space utilization. Since the condenser space extends right up to the evaporator base, the condenser space is configured within the entire "height" of the heat pump or at least within a major portion of the heat pump. At the same time, however, the evaporator space is as large as possible since it also extends almost over the entire height of the heat pump. Due to the mutually interleaved arrangement in contrast to an arrangement where the evaporator is arranged below the condenser, the space is exploited in an optimum manner. This enables particularly efficient operation of the heat pump, on the one hand, and a particularly space-saving and compact design, on the other hand, since both the evaporator and the condenser extend over the entire height. Thus, admittedly, the levels of "thickness" of the evaporator space and of the condenser space decrease. However, one has found that the reduction of the "thickness" of the evaporator space, which tapers within the condenser, is unproblematic since the major part of the evaporation takes place in the lower region, where the evaporator space fills up almost the entire volume available. On the other hand, the reduction of the thickness of the condenser space is uncritical particularly in the lower region, i.e., where the evaporator space fills up almost the entire region available since the major part of the condensation takes place at the top, where the evaporator space is already relatively thin and thus leaves sufficient space for the condenser space. The mutually interleaved arrangement is thus ideal in that each functional space is provided with the large volume where said functional space may use said large volume. The evaporator space has the large volume at the bottom, whereas the condenser space has the large volume at the top. Nevertheless, that corresponding small volume which for the respective functional space remains where the other functional space has the large volume contributes to an increase in efficiency as compared to a heat pump where the two functional elements are arranged one above the other, as is the case, e.g., in WO 2014072239 A1.

In advantageous embodiments, the compressor is arranged on the upper side of the condenser space such that the compressed vapor is redirected by the compressor, on the one hand, and is simultaneously fed into a marginal gap of the condenser space. Thus, condensation with a particularly high level of efficiency is achieved since a cross-flow direction of the vapor in relation to a condensation liquid flowing downward is achieved. This condensation comprising cross-flow is effective particularly in the upper region, where the evaporator space is large, and does not require a particularly large region in the lower region where the condenser space is small to the benefit of the evaporator space, in order to nevertheless allow condensation of vapor particles that have reached said region.

An evaporator base connected to the condenser base is advantageously configured such that it accommodates within it the condenser intake and drain, and the evaporator intake and drain, it being possible, additionally, for certain passages for sensors to be present within the evaporator and/or within the condenser. In this manner, one achieves that no passages of conduits through the evaporator are required for the capacitor intake and drain, which is almost under a vacuum. As a result, the entire heat pump becomes less prone to defects since each passage through the evaporator would present a possibility of a leak. To this end, the condenser base is provided with a respective recess in those positions where the condenser intakes and drains are located, to the effect that no condenser feed inlets/discharge outlets extend within the evaporator space defined by the condenser base.

The condenser space is bounded by a condenser wall, which can also be mounted on the evaporator base. Thus, the evaporator base has an interface both for the condenser wall and for the condenser base and additionally has all of the liquid feed inlets both for the evaporator and for the condenser.

In specific implementations, the evaporator base is configured to comprise connection pipes for the individual feed inlets, which have cross-sections differing from a cross-section of the opening on the other side of the evaporator base. The shape of the individual connection pipes is then configured such that the shape, or cross-sectional shape, changes across the length of the connection pipe, but the pipe diameter, which plays a part in the flow rate, is almost identical with a tolerance of ±10%. In this manner water flowing through the connection pipe is prevented from starting to cavitate. Thus, on account of the good flow conditions obtained by the shaping of the connection pipes, it is ensured that the corresponding pipes/lines can be made to be as short as possible, which in turn contributes to a compact design of the entire heat pump.

In a specific implementation of the evaporator base, the condenser intake is split up into a two-part or multi-part stream, almost in the shape of "eyeglasses". Thus, it is possible to feed in the condenser liquid in the condenser at its upper portion at two or more locations at the same time. Thus, a strong and, at the same time, particularly even condenser flow from top to bottom is achieved which enables achieving highly efficient condensation of the vapor which is introduced into the condenser from the top as well.

A further feed inlet, having smaller dimensions, within the evaporator base for condenser water may also be provided in order to connect a hose therewith which feeds cooling liquid to the compressor motor of the heat pump; what is used to achieve cooling is not the cold liquid which is supplied to the evaporator but the warmer liquid which is supplied to the condenser but which in typical operational situations is still cool enough for cooling the motor of the heat pump.

The evaporator base is characterized in that it exhibits combined functionality. On the one hand, it is ensures that no condenser feed inlets need to be passed through the evaporator, which is under very low pressure. On the other hand, it represents an interface toward the outside, which advantageously has a circular shape since in the case of a circular shape, a maximum amount of evaporator surface area remains. All of the feed inlets/discharge outlets lead through the one evaporator base and from there extend either into the evaporator space or into the condenser space. It is particularly advantageous to manufacture the evaporator base from plastics injection molding since the advantageous, relatively complicated shapes of the intake/drain pipes can be readily implemented in plastics injection molding at low cost. On the other hand, it is readily possible, due to the implementation of the evaporator base as an easily accessible workpiece, to manufacture the evaporator base with sufficient structural stability so that it can readily withstand in particular the low evaporator pressure.

In the present application, identical reference numerals relate to elements which are identical or identical in function; however, not all of the reference numerals will be repeated in all of the drawings if they come up more than once.

Figure 2A:
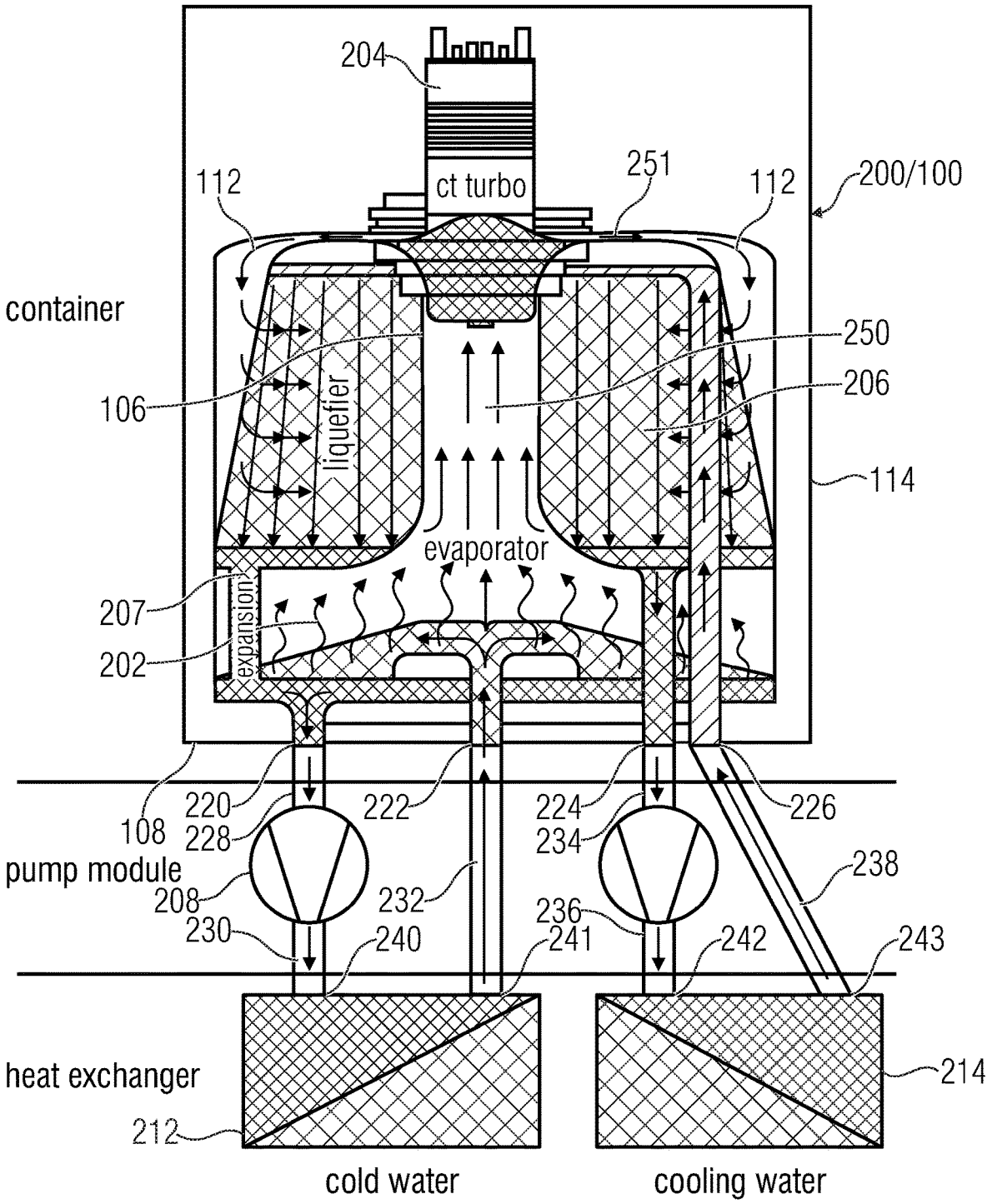
FIG. 2A shows a schematic representation of a heat pump system comprising heat exchangers located at the bottom, in accordance with the first aspect of the present invention.

FIG. 2A shows a heat pump system having a heat pump unit which includes at least one heat pump stage 200, said at least one heat pump stage 200 comprising an evaporator 202, a compressor 204 and a liquefier 206. In addition, a first heat exchanger 212 is provided on a side to be cooled. In addition, a second heat exchanger 214 is provided on a side to be heated. Moreover, the heat pump system includes a first pump 208 coupled to the first heat exchanger 212, and a second pump 210 coupled to the second heat exchanger 214. The heat pump system has an operating position, i.e. a position in which it is operated normally. Said operating position is as depicted in FIG. 2A. In the operating position, the first pump 208 and the second pump 210 are arranged above the first heat exchanger 212 and the second heat exchanger 214. Furthermore, the heat pump unit, which includes at least one heat pump stage 200, is arranged above the first pump 208 and the second pump 210.

The first heat exchanger 212 includes an intake 240 and a drain 241. The intake 240 and the drain 241 are coupled to the heat pump unit. In the implementation wherein the heat pump unit has only one single heat pump stage, as depicted at 200 in FIG. 2A by way of example, the intake 240 leading into the heat exchanger 212 is coupled, via the pump 208, to an evaporator drain 220 via a conduit 208 located in front of the pump 208 and a conduit 230 located behind the pump 208. In addition, the drain 241 leading out of the heat exchanger 212 is coupled to the evaporator intake 222 of the evaporator 202 via a conduit 234. Moreover, a condenser drain 224 of the condenser, or liquefier, 206 is coupled, via the pump 210 and a pipe 236, to an intake 242 leading into the second heat exchanger 214. Also, a drain 243 of the second heat exchanger 214 is coupled to a condenser, or liquefier, intake 226 of the liquefier 206 via a pipe. However, it shall be noted that the pipes 228, 232, 234, 238 may also be coupled to different elements, especially when the heat pump unit comprises not only the one, stage 208 but two stages, as depicted by way of example in FIGS. 3A, 3B, 4A, 5, 6A to 6D. However, it shall be noted that the heat pump unit may include any number of stages, i.e., for example, may also comprise three stages, four, five, etc. stages, apart from two stages.

In the embodiment shown in FIG. 2A, the intake and the drain of the first heat exchanger are arranged, in the operating position, to be perpendicular or at least at an angle of less than 45° in relation to a perpendicular. Moreover, a suction side of the pump 208 is coupled, via the pipe 228, to the heat pump unit and here, by way of example, to the evaporator drain 220. In addition, it shall be noted that during operation, a flow of working liquid flows downward within the Fine 228 as well as within the line 234, as depicted by the arrows. Accordingly, the intake 242 leading into the second heat exchanger and the drain 243 leading out of the second heat exchanger are connected to pipes 234, 236, 238, specifically with the interposed pump 208 and 210, respectively. Said pipes, too, are as perpendicular as possible and are at any rate arranged at an angle of less than 45°. Thus, optimum alignment of the heat pump system and in particular of the individual components of the heat pump system is achieved since particularly the suction sides of the pumps 208, 210 each are arranged within downpipes 228 and 234, respectively, which are as perpendicular as possible. Thus, an optimum dynamic pressure is present in front of the respective pump, to the effect that the pumps 208, 210 work without any or with only very little cavitation.

In addition, it is advantageous for the heat exchangers 212, 214 to be arranged in a lying position. The advantage thereof is that no air inclusions occur within the heat exchangers during filling of the system, so that, the heat exchangers are consequently self-venting. A lying position further means that the heat exchangers are cuboid-shaped and therefore have a floor space that is smaller, in terms of surface area, than the side face. The heat exchanger 212 and the heat exchanger 214 thus each have an elongated shape, the longer side of the cuboid being arranged in a lying position, i.e. horizontally, or at an angle smaller than 45° in relation to the horizontal.

In addition, it shall be noted that both pumps 208, 210 are arranged closer to the first heat exchanger and to the second heat exchanger 214, respectively, than to a connection point at the heat pump unit. This means that the pipe 228 is longer than the pipe 230 and that the pipe 234 is longer than the pipe 236.

Moreover, the heat pump unit is configured such that at least one inlet or one outlet of an evaporator or liquefier of a heat pump stage that is connected to the first heat exchanger or to the second heat exchanger is arranged to exit from the heat pump stage, in the operating position, in a manner that is perpendicularly downward or at an angle smaller than 45° from a vertical line from the heat pump stage. The outlets 220, 234 and the inlets 222, 226, respectively, are drawn to be perpendicular, which position is advantageous. In addition, the heat pump stage 200 is advantageously implemented in the interleaved arrangement, as was also described by means of FIG. 1, namely wherein a vapor feed channel 250, through which vapor from the evaporator 202 is directed to the compressor 204, extends within the corresponding condenser. Furthermore, the heat pump stage 200 is advantageously implemented in the interleaved arrangement, as was also described by means of FIG. 1, namely wherein a vapor feed channel 250, through which vapor from the evaporator 202 is directed to the compressor 204, extends within the liquefier 206. Additionally, the vapor feed channel between the compressor 204 and the condenser 206, which is drawn in at 251, is mounted above the liquefier 206.

As shown in FIG. 2A, the liquefier 204 further is also arranged to extend above the liquefier 206, so that in an off state, working liquid flows away from the compressor due to gravity. Therefore, the compressor will be in a dry state when the heat pump stage 200 is deactivated, which comes about by the compressor motor 204 being switched off.

Figures 8A, 8B:
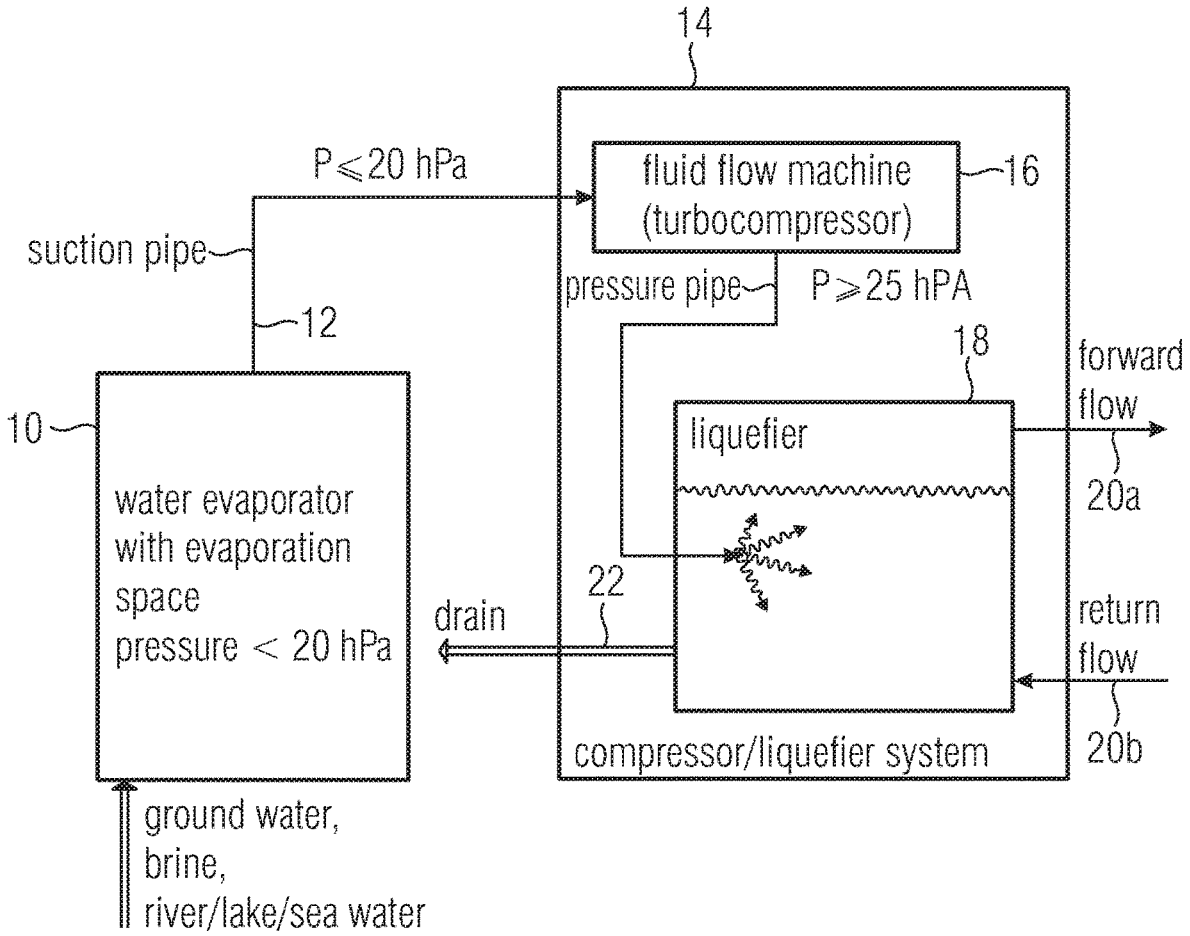
Fig. 8A (PRIOR ART)
FIG. 8A shows a schematic representation of a known heat pump system comprising water as the working medium.
FIG. 8B shows a table for depicting different pressure/temperature situations for water as the working liquid.

Aside from that, it shall be noted that water is advantageously used as the working medium; the at least one heat pump stage is configured to maintain a pressure at which the water can evaporate at temperatures below 50° C. In particular in the two-stage arrangement, which will be addressed below with reference to FIGS. 3A, 3B, 4A, 6A to 6D, and 5, evaporation within the first heat pump stage will take place, e.g., at temperatures from 20° C. to 30° C., and evaporation within the second heat pump stage will take place, e.g., at temperatures from 40° C. to 50° C. However, depending on the implementation, the temperatures may be lower, as depicted by way of example with reference to FIG. 8 or FIG. 7C.

Advantageously, the entire heat pump system is mounted on a carrier rack, which is not depicted. In particular, the first and second heat exchangers 212, 214 are attached at the bottom of the carrier rack. Moreover, the first and second pumps are connected to each other via a pump holder and are attached, as a pump module, to the carrier rack above the first and second heat exchangers 212, 214. The at least one heat pump stage will then be arranged above the pump carrier.

In advantageous embodiments, the heat pump system is configured to have two stages and exhibits a height smaller than 2.50 m, a width smaller than 2 m, and a depth smaller than 1 m.

FIG. 2A shows the first aspect, wherein the heat pump system has the heat exchangers arranged at a lower end.

Figure 2B:
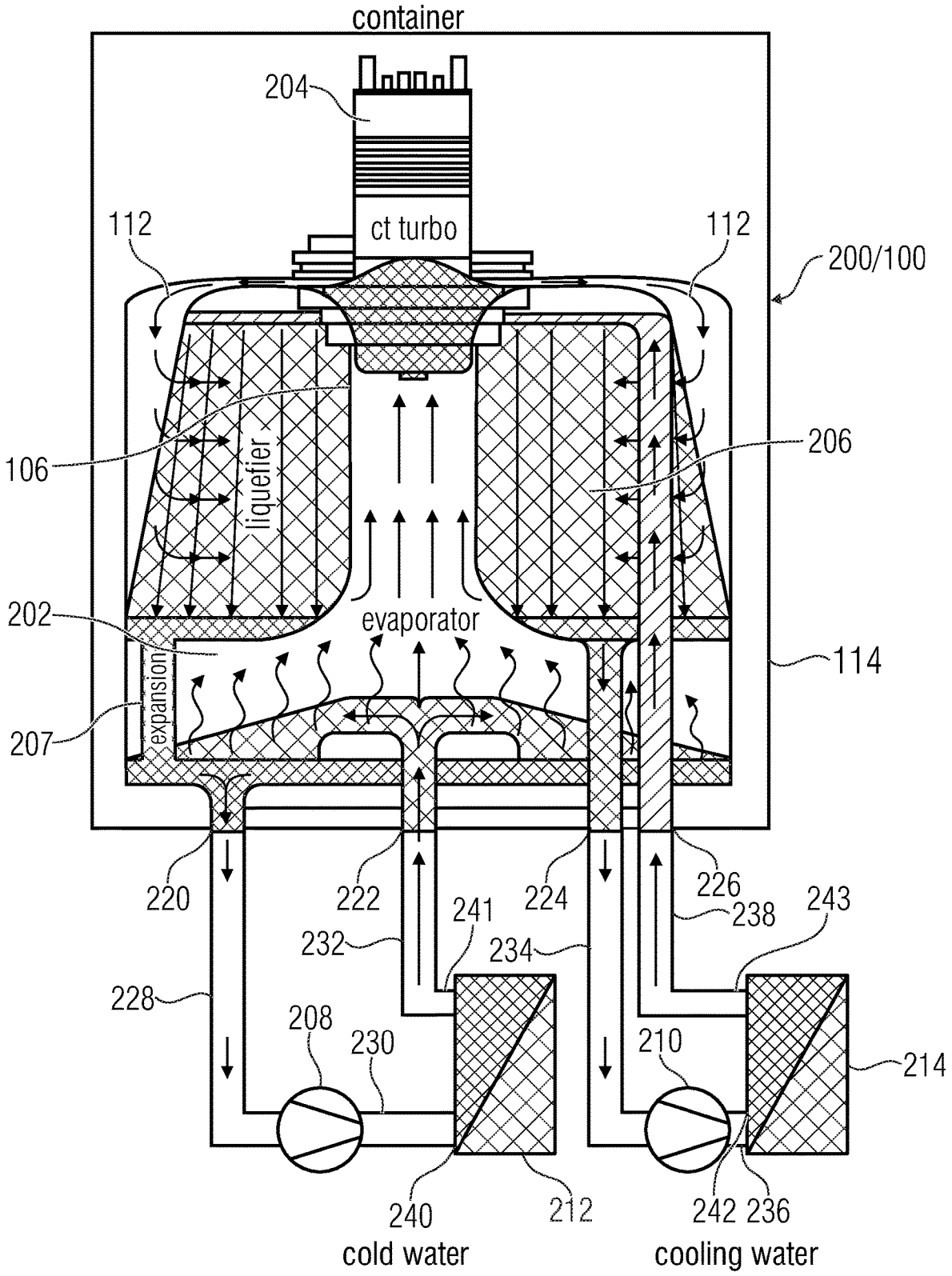
FIG. 2B shows a schematic representation of a heat pump system comprising heat exchangers located at the bottom, in accordance with the second aspect of the present invention.

In contrast, FIG. 2B shows the second aspect, wherein the pumps are arranged at the very bottom and wherein, in advantageous implementations of the second aspect, the heat exchangers 212, 214 are arranged in an upright position and/or next to the pumps. In particular, in accordance with the second aspect in FIG. 2B, a heat pump system is shown which comprises the heat pump stage 200 having the first compressor 204, the first liquefier 206, and the first evaporator 202. In addition, as also shown in FIG. 2A, an expansion organ 207 is provided for accomplishing the equalization of liquid between the liquefier 206 and the evaporator 202. Moreover, the first heat exchanger 212 and the second heat exchanger 214 are associated with a side to be cooled and a side to be heated, respectively. In addition, the first pump 208 and the second pump 210 are provided, the first pump 208 being coupled to the first heat exchanger 212, and the second pump 210 being coupled to the second heat exchanger 214. Again, the heat pump system has an operating position which is as schematically depicted in FIG. 2B.

The first and second pumps are arranged, in the operating position, below the heat pump unit 200 at a lower end of the heat pump system. In addition, in the operating position, the first and second heat exchangers are also arranged below the heat pump unit at the lower end, next to the pumps 208, 210, as schematically depicted in FIG. 2B. In particular, the first pump 208 and the second pump 210 are arranged such that a pumping direction of the respective pump extends horizontally or deviates from the horizontal by a maximum of +/−45° in the operating position. Besides, the two heat exchangers 212, 214, or at least one of the two heat exchangers 212, 214, are arranged in the upright position, wherein the first connection 240, 242 of the first and second heat exchangers 212, 214, respectively, are coupled to a pumping side of the respective pump 208, 210, and wherein the second connection 241, 243 of the first and second heat exchangers 212 and 214, respectively, is arranged above the respective first connection 240, 242 of the corresponding heat exchanger. In other words, the heat exchanger 212 is arranged such that the second connection 241, which represents the drain leading away from the first heat exchanger 212, is arranged, in the operating direction, above the first connection 240 representing the intake. Accordingly, with the second heat exchanger 214, the drain, i.e. the second connection 243 is arranged, in the operating position, above the intake 242, or the first connection 242, of the second heat exchanger 214. The upright arrangement is advantageous since air inclusions are avoided during filling of the heat exchangers. Moreover, due to the upright position of the heat exchanger, the pipe connection, and in particular the pipe 232 and/or 238, will be shorter as compared to a lying arrangement. This is due to the fact that the extension of the heat exchanger is already employed as a connection pipe, as it were. Therefore, the heat exchanger is used not only as a heat exchanger element but also as a connecting lead.

Moreover, the pumps are arranged as far down as possible, specifically advantageously horizontally, so that the dynamic pressure that may be used and is present in front of the suction side of the pump is readily achieved, when the entire heat pump system has a predefined height, by means of a maximum-length vertical pipe arranged in front of the pump so as to avoid pump cavitation. Moreover, the first pipe 228 by means of which the evaporator exit 220 is coupled to the suction side of the pump 208, exhibits a curvature, it being advantageous for the curvature to be arranged closer to the suction side of the pump 208 than to the evaporator exit 220. Accordingly, also the curvature present within the second pipe 234, which connects the condenser exit 224 and the suction side of the pump 210, is arranged closer to the pump than to the condenser exit 224 so as to have as long a perpendicular stretch as possible by means of which the dynamic pressure that may be used is achieved, i.e. by means of which the working medium which comes rushing down already is given a good thrust of kinetic energy.

Figure 3A:
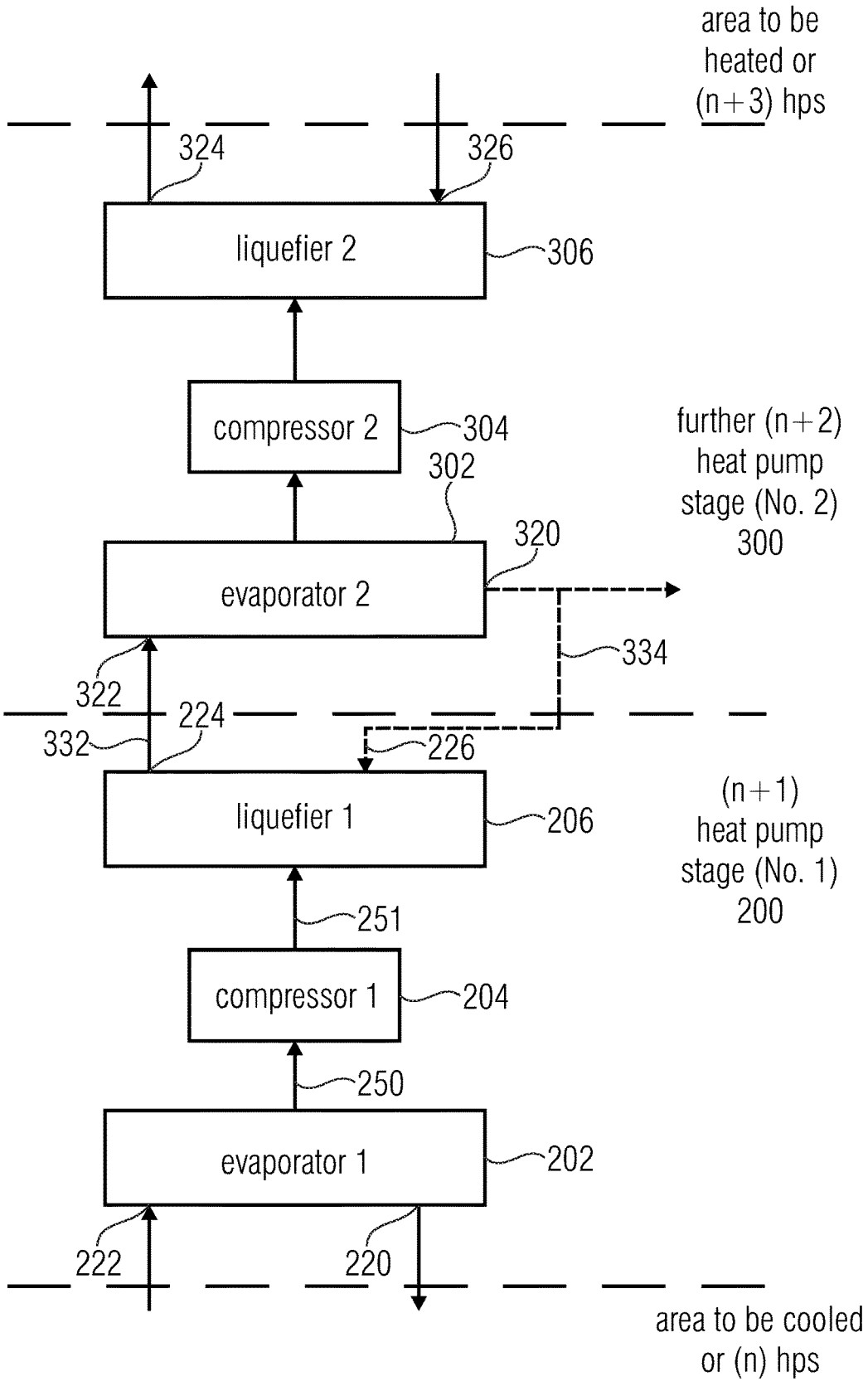
FIG. 3A shows a schematic representation of a heat pump system comprising a first and further cascaded heat pump stages in accordance with the third aspect of the present invention.

FIG. 3A shows a third aspect of a heat pump system, wherein the heat pump system of the third stage may comprise any arrangement of pumps or heat exchangers; however, as will be set forth below by means of FIGS. 3B, 4A, 5, it is advantageous to use the arrangement in accordance with the first aspect. Alternatively, however, if is also possible to use the arrangement in accordance with the second aspect, i.e. with pumps that are arranged as far down as possible and with advantageously upright heat exchangers.

In particular, a heat pump system as shown in FIG. 3A includes a heat pump stage 200, i.e. the stage n+1 comprising a first evaporator 202, a first compressor 204, and a first liquefier 206, the compressor 202 being coupled to the compressor 204 via the vapor channel 250, and as soon as the compressor 204 is coupled to the liquefier 206 via the vapor channel 251. It is advantageous to use the interleaved arrangement again; however, any arrangements may be used in the heat pump stage 200. The entrance 222 into the evaporator 202 and the exit 220 from the evaporator 202 are connected, depending on the implementation, either to an area to be cooled or to a heat exchanger, e.g. the heat exchanger 212, to the area to be cooled or to a further heat pump stage arranged in front of the latter, namely, e.g., the heat pump stage n, n being an integer larger than or equal to zero.

Additionally, the heat pump system in FIG. 3A includes a further heat pump stage 300, i.e. the stage n+2, comprising a second evaporator 302, a second compressor 304, and a second liquefier 306. In particular, the exit 224 of the first liquefier is connected to an evaporator entrance 322 of the second evaporator 320 via a connecting lead 332. The exit 320 of the evaporator 302 of the further heat pump stage 300 may be connected, depending on the implementation, to the inlet into the liquefier 206 of the first heat pump stage 200, as shown by a dashed connecting lead 334. However, as depicted by FIGS. 4A, 6A to 6D, and 5, the exit 320 of the evaporator 302 may also be connected to a controllable way module so as to achieve alternative implementations. However, due to the fixed connection of the liquefier exit 224 of the first heat pump stage to the evaporator entrance 332 of the further heat pump stage, a cascade connection is generally achieved.

Said cascade connection ensures that each heat pump stage operates at as small a temperature spread as possible, i.e. at as small a difference as possible between the heated working liquid and the cooled working liquid. By connecting such heat pump stages in series, i.e. by cascading such heat pump stages, one achieves that a sufficiently large total spread is nevertheless achieved. Thus, the total spread is subdivided into several individual Spreads. The cascade connection is of particular advantage in particular since it enables substantially more efficient operation. The consumption of compressor power for two stages, each of which has to accomplish a relatively small temperature spread, is smaller than the evaporator power used for one single heat pump stage which achieves a large temperature spread. In addition, from a technical point of view the requirements placed upon the individual components are smaller in the event of there being two cascaded stages.

Figure 3B:
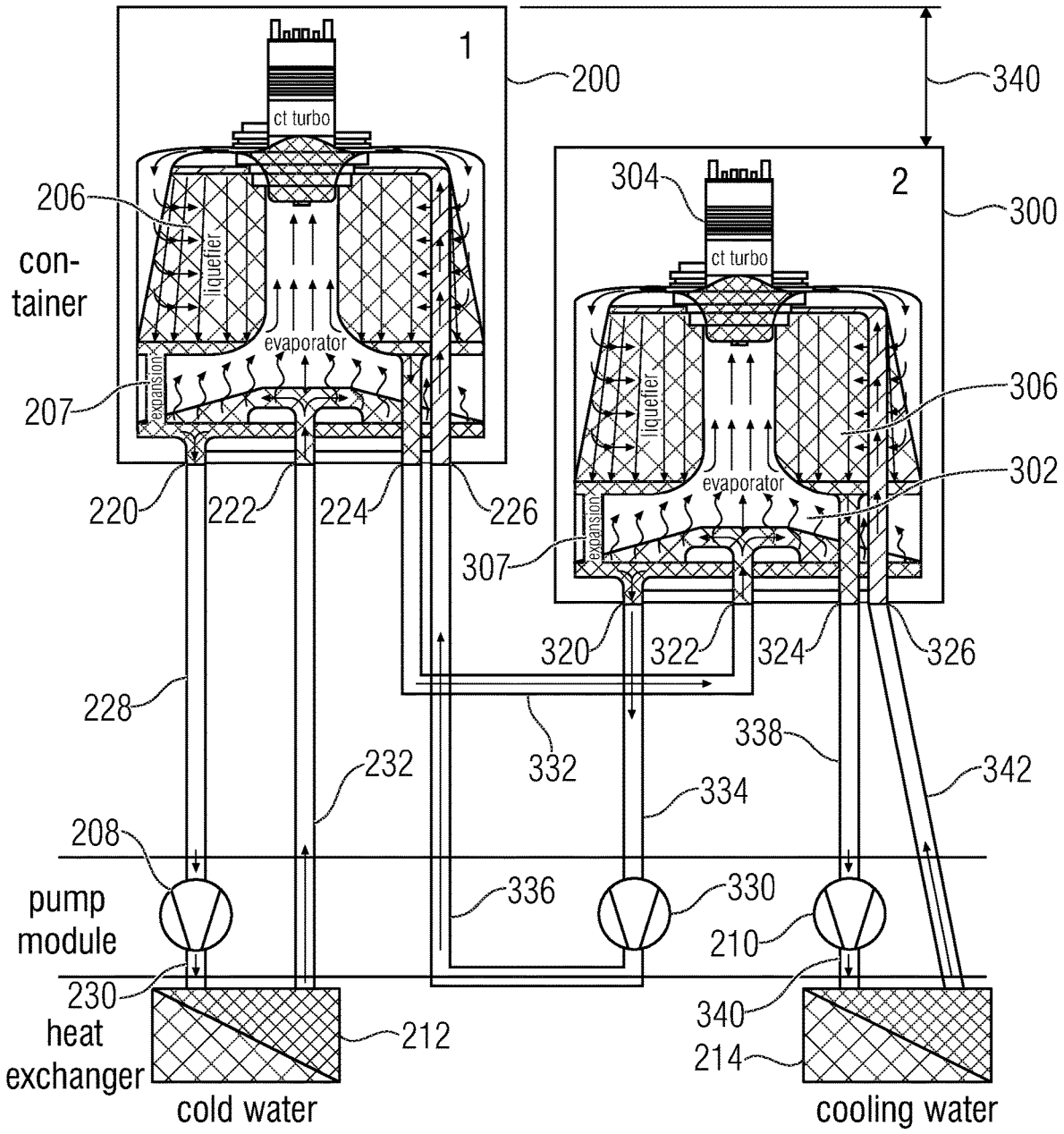
FIG. 3B shows a schematic representation of two firmly cascaded heat pump stages.

As shown in FIG. 3A, the liquefier exit 324 of the liquefier 306 of the further heat pump stage 300 may be coupled to the area to be heated, as is depicted, e.g., with reference to FIG. 3B by means of the heat exchanger 214. However, alternatively, the exit 324 of the liquefier 306 of the second heat pump stage may again be coupled to an evaporator of a further heat pump stage, i.e. the (n+3) heat pump stage, via a connecting pipe. Thus, depending on the implementation, FIG. 3A shows a cascade connection of, e.g., four heat pump stages if n=1 is assumed. However, if n is assumed to be any number, FIG. 3A shows a cascade connection of any number of heat pump stages, wherein, in particular, the cascade connection of the heat pump stage (n+1), designated by 200, and of the further heat pump stage 300, designated by (n+2), is set forth in more detail, and wherein the n heat pump stage as well as the (n+3) heat pump stage may be implemented as a heat exchanger or as an area to be cooled and/or to be heated, respectively, rather than as a heat pump stage.

As is depicted in FIG. 3B, for example, the liquefier of the first heat pump stage 200 is advantageously arranged above the evaporator 302 of the second heat pump stage, so that the working liquid flows through the connecting lead 332 due to gravity. In particular in the specific implementation, shown in FIG. 3B, of the individual heat pump stages, the liquefier is arranged above the evaporator anyway. Said implementation is particularly favorable since even with mutually aligned heat pump stages, the liquid already flows out of the liquefier of the first stage and into the evaporator of the second stage through the connecting lead 332. However, it is additionally advantageous to achieve a difference in height which includes at least 5 cm between the upper edge of the first stage and the upper edge of the second stage. Said dimension, which is shown at 340 in FIG. 3B, however advantageously amounts to 20 cm since in this case, optimum transport of water takes place, for the implementation described, from the first stage 200 to the second stage 300 via the connecting lead 332. In this manner one also achieves that no specific pump is required within the connecting lead 332. Therefore, said pump is saved. Only the intermediate-circuit pump 330 may be used so as to bring the working liquid from the exit 320 of the evaporator of the second stage 300, which is arranged to be lower than the first stage, back into the condenser of the first stage, i.e. into the entrance 226. To this end, the exit 320 is connected to the suction side of the pump 330 via the conduit 334. The pumping side of the pump 330 is connected to the entrance 226 of the condenser via the pipe 336. The cascade connection, shown in FIG. 3B, of the two stages corresponds to FIG. 3A comprising the connection 334. Advantageously, the intermediate-circuit pump 330 is arranged at the bottom, just like the other two pumps 208 and 210, since in this case, cavitation may also be prevented within the intermediate-circuit line 334 since sufficient dynamic pressure of the pump is achieved due to the intermediate-circuit pump 330 being positioned within the downpipe 334.

Even though FIG. 3B shows the configuration in accordance with the first aspect, i.e. where the heat exchangers 212, 214 are arranged below the pumps 208, 210 and 330, it is also possible to use the arrangement where the pumps 208, 210 are placed next to the heat exchangers 212, 214, as was set forth in accordance with the second aspect.

As is shown in FIG. 3B, the first stage includes the expansion element 207, and the second stage includes an expansion element 307. However, since working liquid exits from the liquefier 206 of the first stage via the connecting lead 332 anyway, the expansion element 207 may be dispensed with. By contrast, the expansion element 307 in the bottommost stage is advantageously used. Thus, in one embodiment, the first stage may be designed without any expansion element, and an expansion element 307 is provided in the second stage only. However, since it is advantageous to build all stages in an identical manner, the expansion element 207 is provided also in the heat pump stage 200. If said expansion element 207 is implemented to support nucleate boiling, the expansion element 207 will also be helpful despite the fact that it may possibly not direct any liquefied working liquid, but only heated vapor, into the evaporator.

Nevertheless it has turned out that in the arrangement shown in FIG. 3B, working liquid accumulates within the evaporator 302 of the second heat pump stage 300. Therefore, as depicted in FIG. 5, a measure is taken to direct working liquid from the evaporator 302 of the second heat pump stage 300 into the evaporator circuit of the first stage 200. To this end, an overflow arrangement 502 is arranged within the second evaporator 302 of the second heat pump stage so as to lead off working liquid as of a predefined maximum level of working liquid present within the second evaporator 302. In addition, a liquid line 504, 506, 508 is provided which is coupled to the overflow arrangement 502, on the one hand, and is coupled to a suction side of the first pump 208 at a coupling point 512, on the other hand. A pressure reducer 510, which is advantageously configured as a Bernoulli pressure reducer, i.e. as a pipe or hose bottleneck, is located at the coupling point 512. The liquid line includes a first connection portion 504, a U-shaped portion 506, and a second connection portion 508. Advantageously, the U-shaped portion 506 has a vertical height, in the operating position, which is at least equal to 5 cm and is advantageously 15 cm. Thus, a self-regulating system is obtained that operates without any pump. If the water level within the evaporator 302 of the lower container 300 is too high, working liquid flows into the U pipe 506 via the connecting lead 504. The U pipe is coupled to the suction side of the pump 208 via the connecting lead 508 at the coupling point 512 at the pressure reducer. Due to the increased flow velocity in front of the pump due to the bottleneck 510, the pressure decreases, and water from the U pipe 506 can be received. Within the U pipe, a stable water level will become established, which will be sufficient for the pressure present in front of the pump within the bottleneck and within the evaporator of the lower container. At the same time, however, the U pipe 506 presents a vapor barrier to the effect that no vapor may get from the evaporator 302 into the suction side of the pump 208. The expansion organs 207 and/or 307 are advantageously also configured as overflow arrangements so as to direct working liquid into the respective evaporator when predetermined level within a respective liquefier is exceeded. Thus, the filling levels of all containers, i.e. of all liquefiers and evaporators, in both heat pump stages are set automatically in a self-regulating manner, without any additional expenditure and without any pumps.

This is advantageous, in particular, since in this manner, heat pump stages may be put into or out of operation as a function of the operating mode.

Figure 4A:
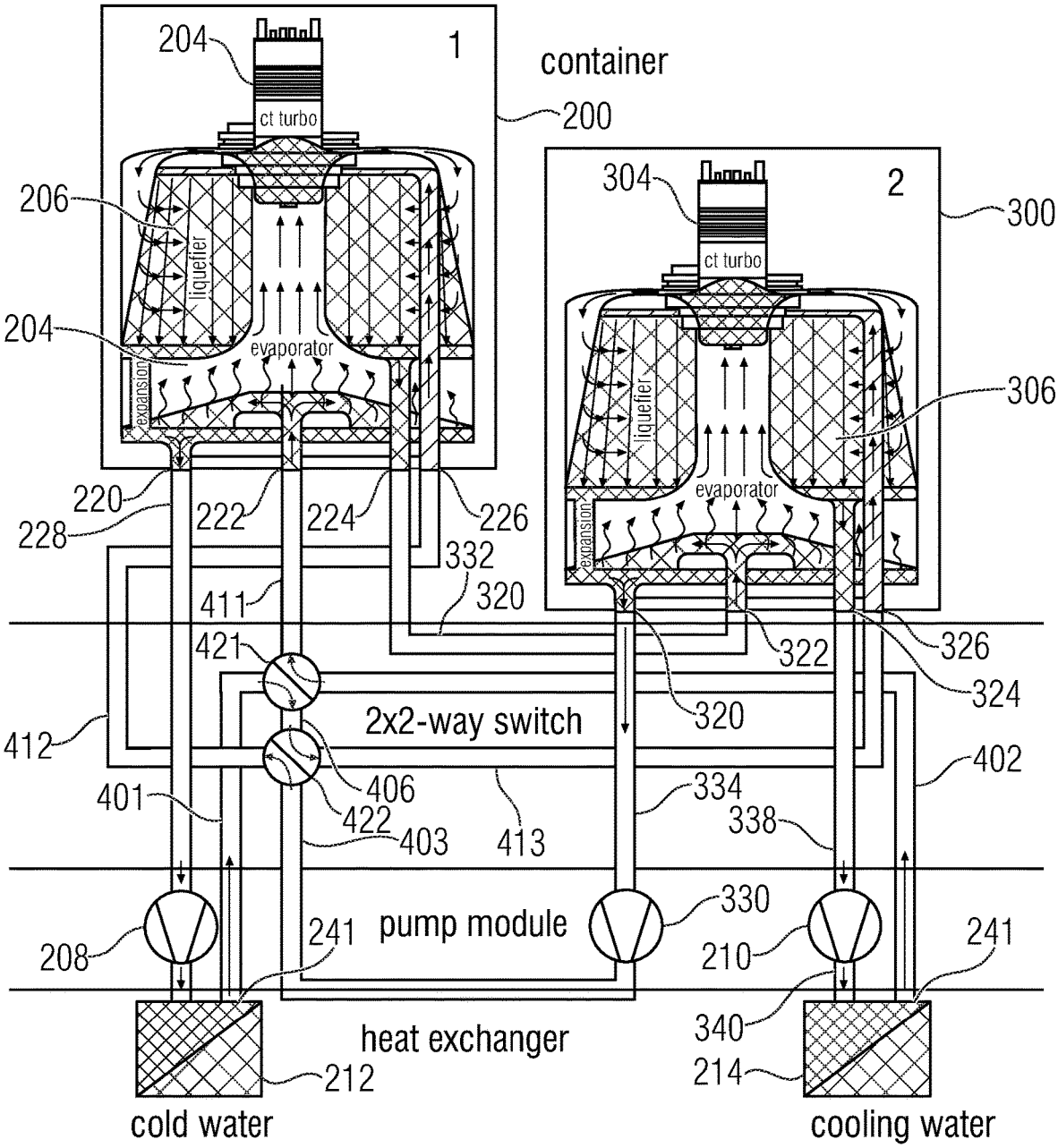
FIG. 4A shows a schematic representation of cascaded heat pump stages coupled to controllable way switches.
Figures 4B, 4C:
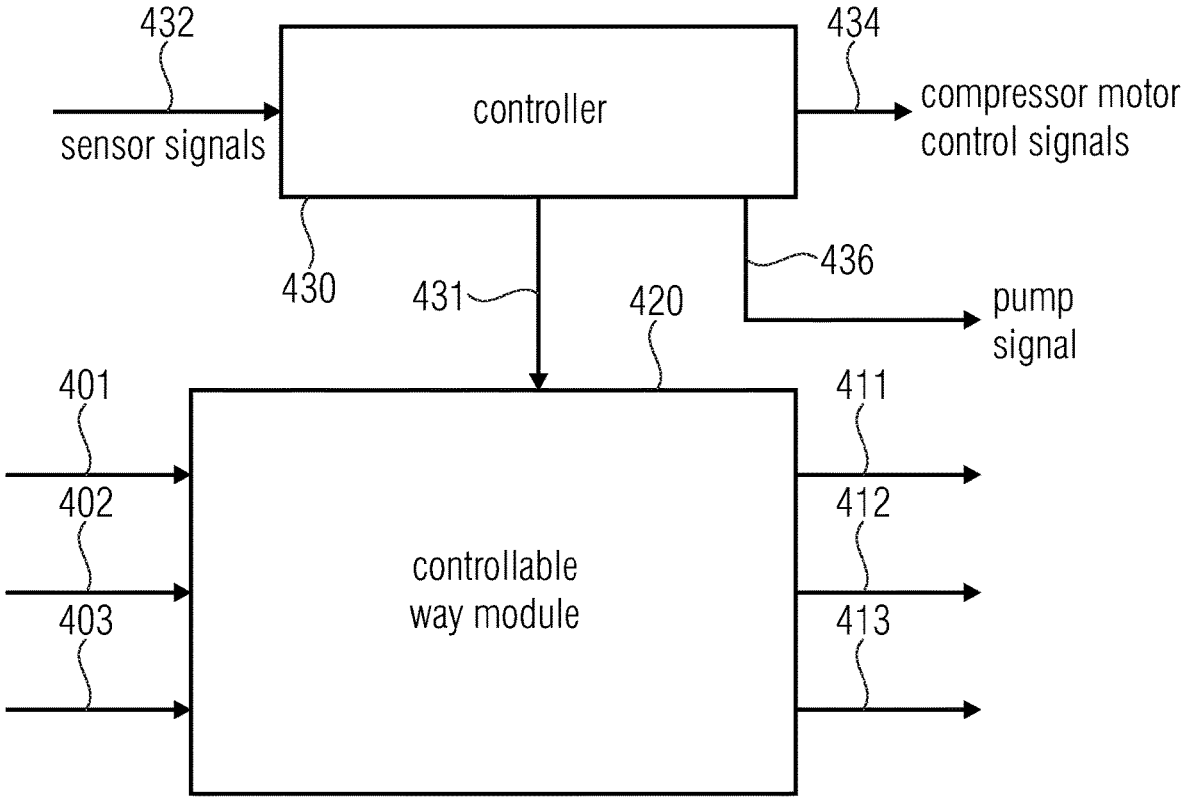
FIG. 4B shows a schematic representation of a controllable way module comprising three inputs and three outputs.
FIG. 4C shows a table for depicting the various connections of the controllable way module for different modes of operation.
Figure 5:
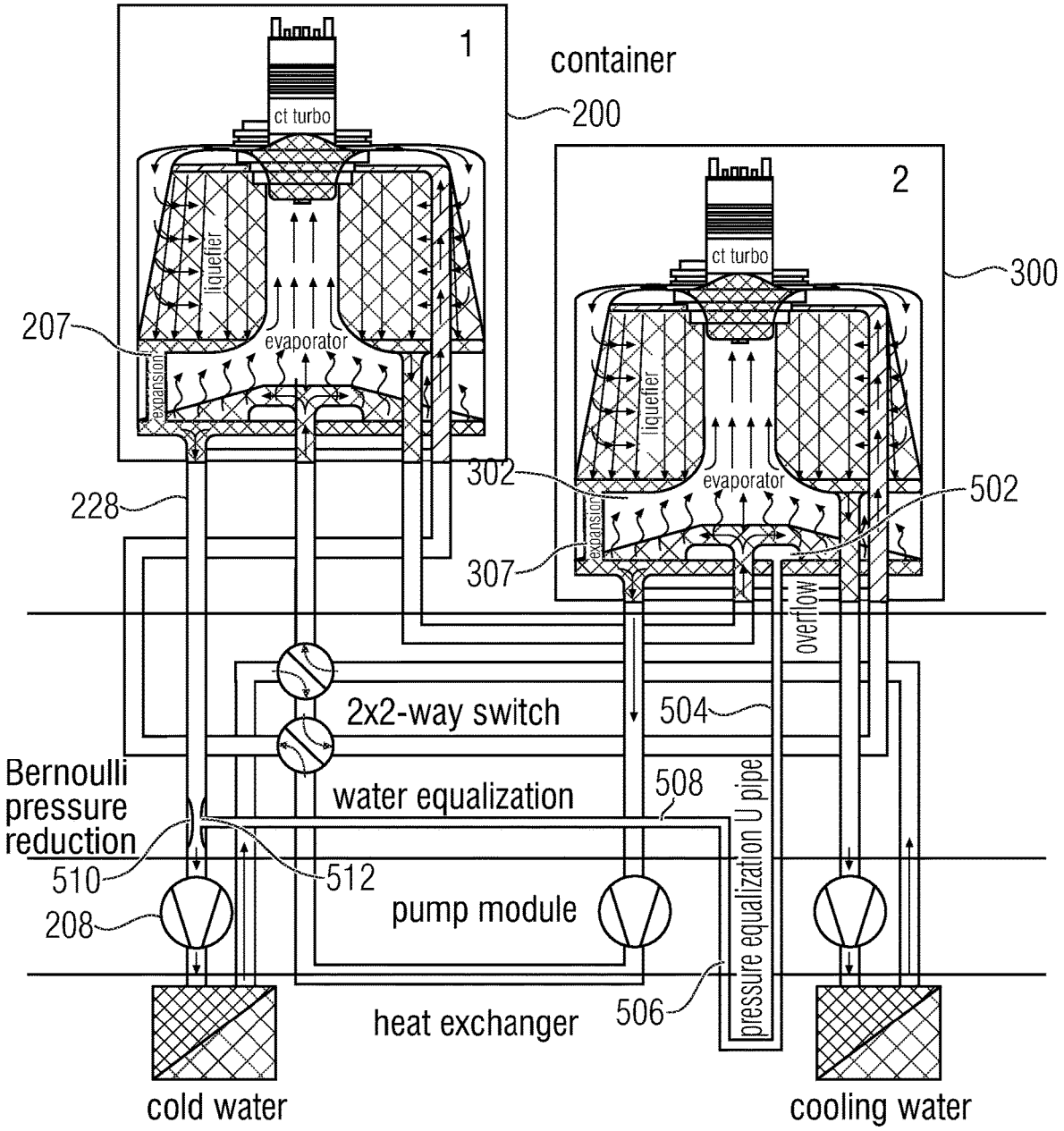
FIG. 5 shows a schematic representation of the heat pump system of FIG. 4A comprising additional self-regulating equalization of liquid between the heat pump stages.

FIGS. 4A and 5 already show a detailed depiction of a controllable way module on the grounds of the upper 2×2-way switch 421 and the lower 2×2-way switch 422. FIG. 4B shows a general implementation of the controllable way module 420 which may be implemented by the two serially connected 2×2-way switches 421 and 422, but which may also be implemented in an alternative manner.

The controllable way module 420 of FIG. 4B is coupled to a controller 430 so as to be controlled by same via a control line 431. The controller receives sensor signals 432 as input signals and provides pump control signals 436 and/or compressor motor control signals 434 on the output side. The compressor motor control signals 434 lead to the compressor motors 204, 304 as shown in FIG. 4A, for example, and the pump control signals 436 lead to the pumps 208, 210, 330. Depending on the implementation, however, the pumps 208, 210 may be configured to be fixed, i.e. to be non-controlled, since they anyway run in any of the operating modes described by means of FIGS. 7A, 7B. It is therefore only the intermediate-circuit pump 330 that might be controlled by a pump control signal 436.

The controllable way module 420 includes a first input 401, a second input 402 and a third input 403. As shown in FIG. 4A, for example, the first input 401 is connected to the drain 241 of the first heat exchanger 212. In addition, the second input 402 of the controllable way module is connected to the return flow, or drain, 243 of the second heat exchanger 214. In addition, the third input 403 of the controllable way module 420 is connected to a pumping side of the intermediate-circuit pump 330.

A first output 411 of the controllable way module 420 is coupled to an input 222 into the first heat pump stage 200. A second output 412 of the controllable way module 420 is connected to an entrance 226 into the liquefier 206 of the first heat pump stage. In addition, a third output 413 of the controllable way module 420 is connected to the input 326 into the liquefier 306 of the second heat pump stage 300.

The various input/output connections that are achieved by means of the controllable way module 420 are depicted in FIG. 4C.

In one mode, the high-performance mode (HPM), the first input 401 is connected to the first output 411. Moreover, the second input 402 is connected to the third output 413. In addition, the third input 403 is connected to the second output 412, as depicted in line 451 of FIG. 4C.

In the medium-performance mode (MPM), wherein only the first stage is active and the second stage is inactive, i.e. the compressor motor 304 of the second stage 300 is switched off, the first input 401 is connected to the first output 411. Further, the second input 402 is connected to the second output 412. Furthermore, the third input 403 is connected to the third output 413, as depicted in line 452. Line 453 shows the free-cooling mode wherein the first input is connected to the second output, i.e. the input 401 is connected to the output 412. Moreover, the second input 402 is connected to the first output 411. Finally, the third input 403 is connected to the third output 413.

In the low-performance mode (LPM), depicted in line 454, the first input 401 is connected to the third output 413. Additionally, the second input 402 is connected to the first output 411. Finally, the third input 403 is connected to the second output 412.

It is advantageous to implement the controllable way module by means of the two serially arranged 2-way switches 421 and 422 as are depicted in FIG. 4A, for example, or as are also depicted in FIGS. 6A to 6D. Here, the first 2-way switch 421 comprises the first input 401, the second input 402, the first output 411, and a second output 414, which is coupled to an input 404 of the second 2-way switch 422 via an interconnection 406. The 2-way switch has the third input 403 as an additional input and has the second output 412 as an output, and has the third output 413 also as an output.

Figure 6A:
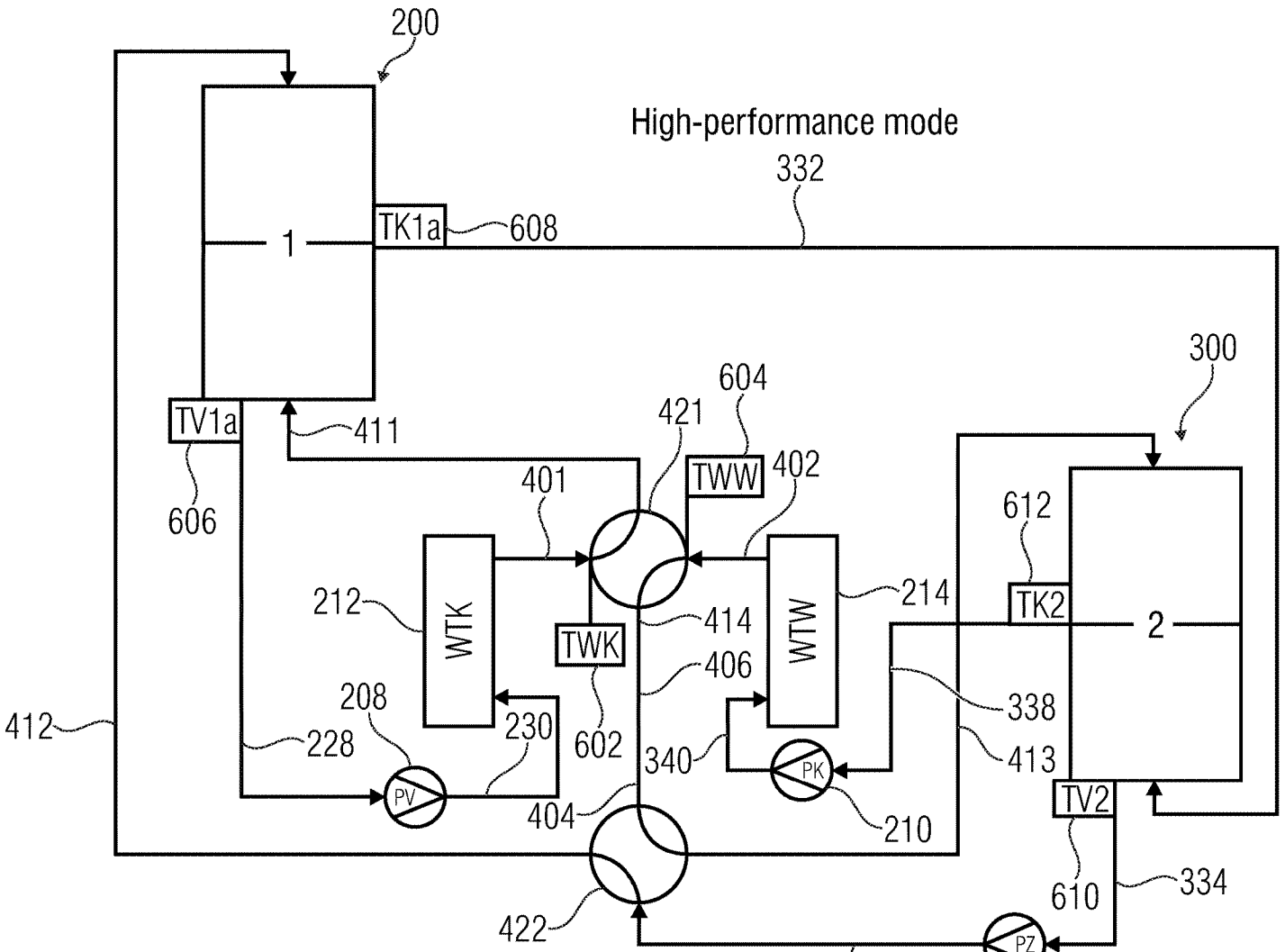
FIG. 6A shows a schematic representation of the heat pump system comprising two stages which is operated in the high-performance mode (RPM)
Figure 6B:
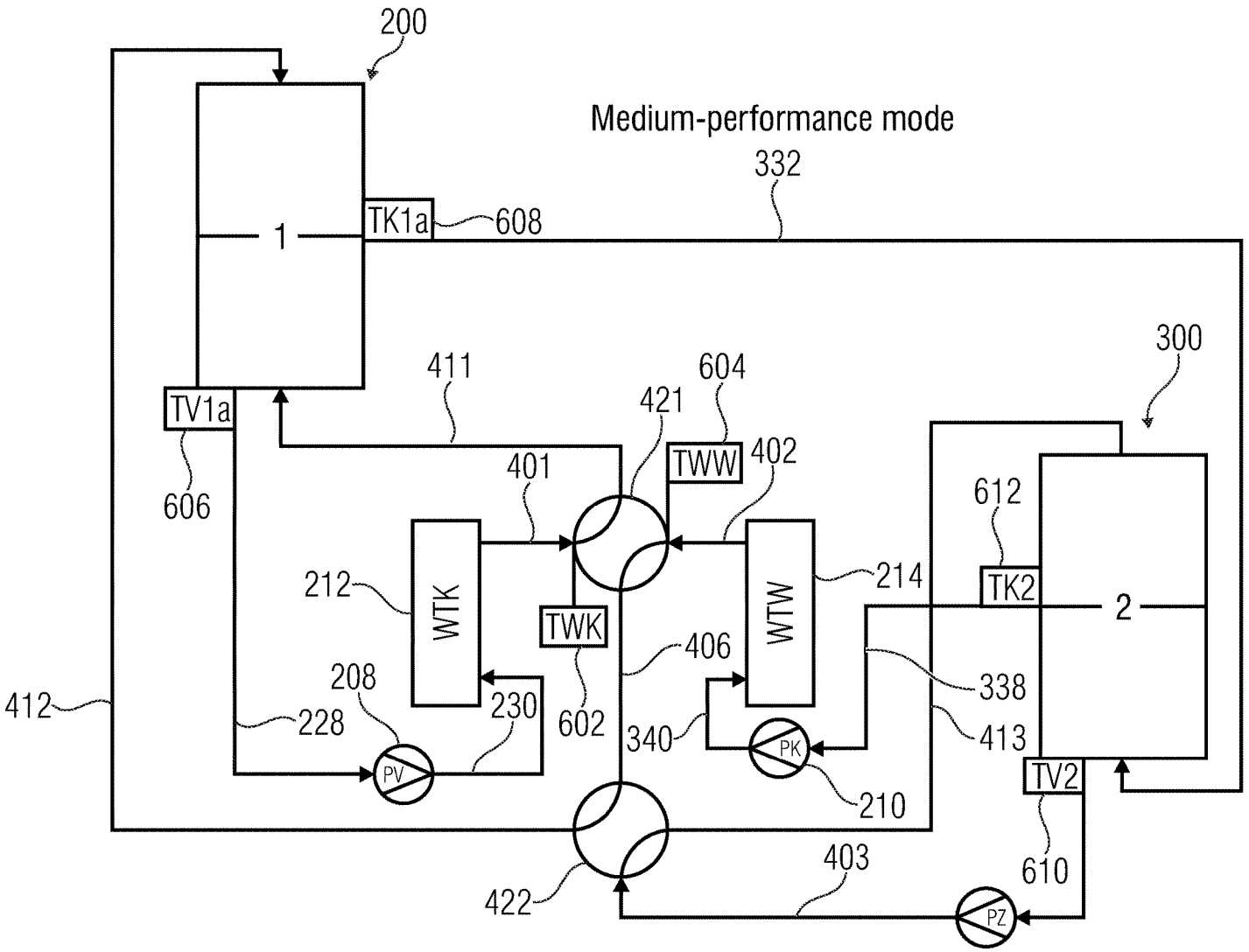
FIG. 6B shows a schematic representation of the heat pump system comprising two stages which is operated in the medium-performance mode (MPM)

The positions of the 2×2-way switches 421 are depicted in a tabular manner in FIG. 7B. FIG. 6A shows both positions of the switches 421, 422 in the high-performance mode (HPM). This corresponds to the first line in FIG. 7B. FIG. 6B shows the positions of both switches in the medium-performance mode. The upper switch 421 is just the same in the medium-performance mode as it is in the high-performance mode. Only the lower switch 422 has been switched. In the free-cooling mode depicted in FIG. 6C, the lower switch is the same as it is in the medium-performance mode. Only the upper switch has been switched. In the low-performance mode, the lower switch 422 has been switched as compared to the free-cooling mode, whereas the upper switch is the same in the low-performance mode as it is in the free-cooling mode. This ensures that from one neighboring mode to the next mode, only one switch needs to be switched in each case, whereas the other switch may remain in its position. This simplifies the entire measure of switching from one mode of operation to the next.

FIG. 7A shows the activities of the individual compressor motors and pumps in the various modes. In all modes, the first pump 208 and the second pump 210 are active. The intermediate-circuit pump is active in the high-performance mode, the medium-performance mode and the free-cooling mode but is deactivated in the low-performance mode.

The compressor motor 204 of the first stage is active in the high-performance mode, the medium-performance mode and the free-cooling mode, and is deactivated in the low-performance mode. In addition, the compressor motor of the second stage is active in the high-performance mode only but is deactivated in the medium-performance mode, in the free-cooling mode and in the low-performance mode.

It shall be noted that FIG. 4A depicts the low-performance mode, wherein both motors 204, 304 are deactivated and wherein the intermediate-circuit pump 330 is activated. By contrast, FIG. 3B shows the high-performance mode, which is firmly coupled, as it were, wherein both motors and all pumps are active. FIG. 5 in turn shows the high-performance mode, wherein the switch positions are such that precisely the configuration of FIG. 3B is obtained.

Figure 6C:
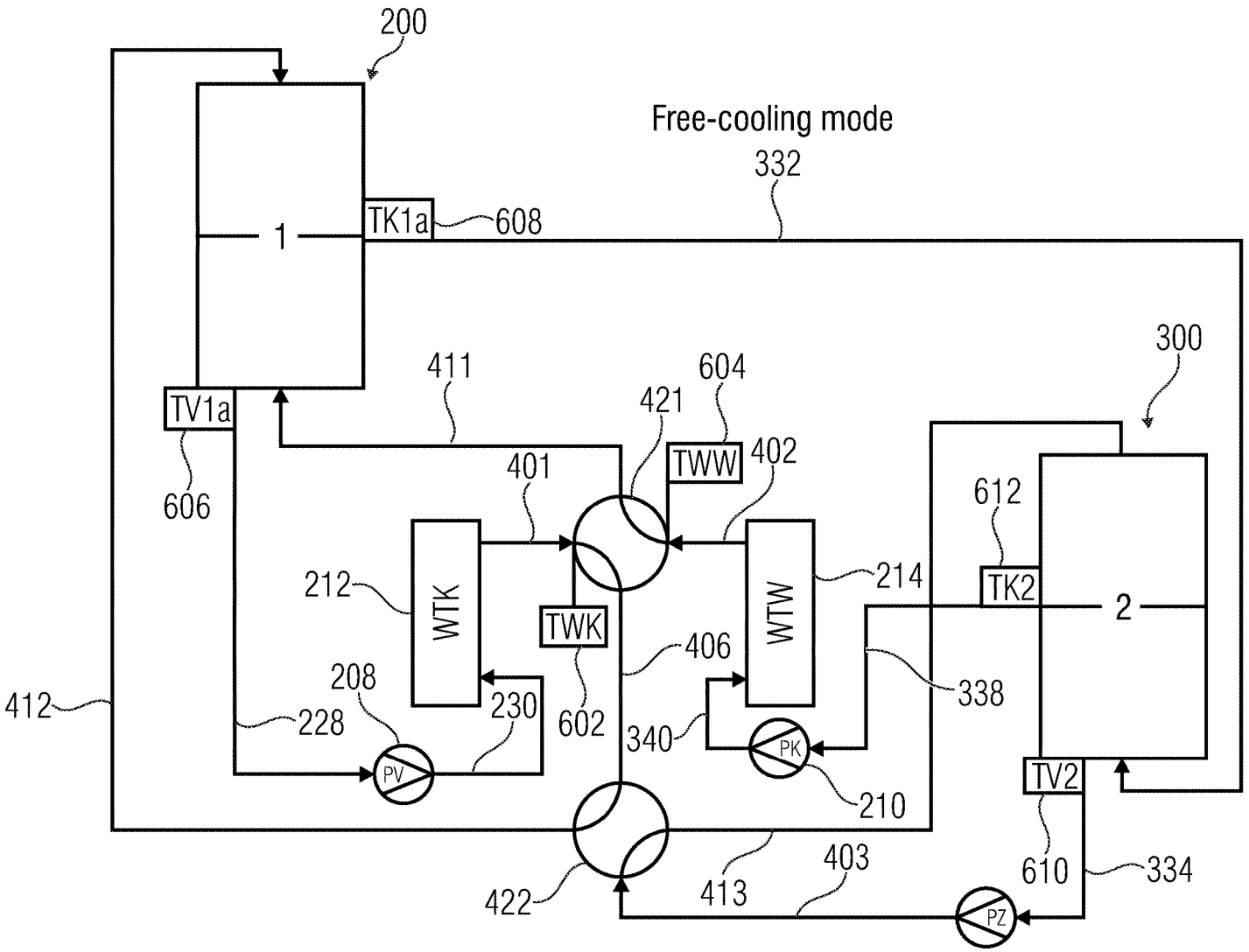
FIG. 6C shows a schematic representation of the heat pump system comprising two stages which is operated in the free-cooling mode (FCM)
Figure 6D:
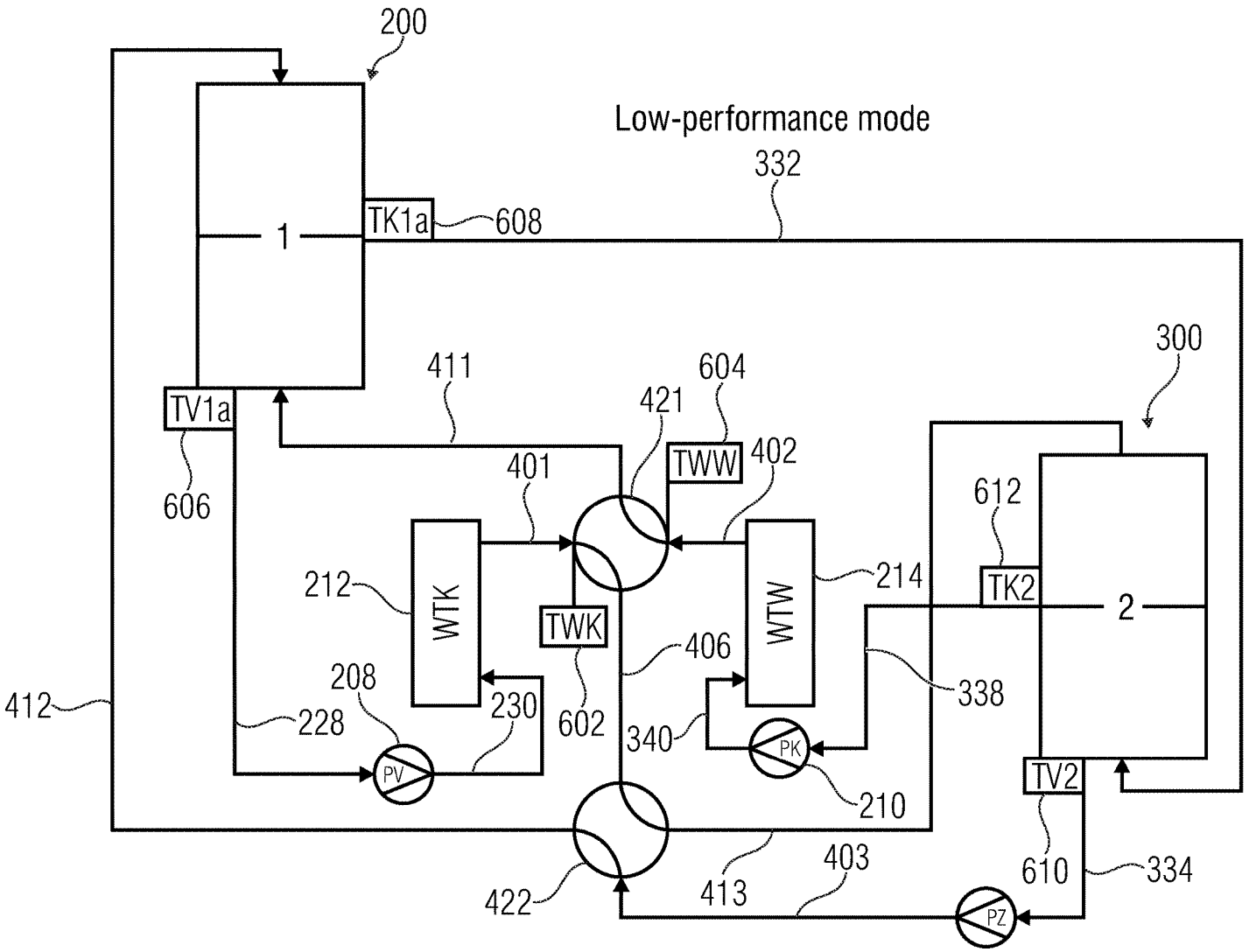
FIG. 6D shows a schematic representation of the heat pump system comprising two stages which is operated in the low-performance mode (LPM)

FIGS. 6A and 6C further show different temperature sensors. A sensor 602 measures the temperature at the output of the first heat exchanger 212. i.e. at the return flow from the side to de cooled. A second sensor 604 measures the temperature at the return flow of the side to be heated, i.e. from the second heat exchanger 214. In addition, a further temperature sensor 606 measures the temperature at the exit 220 of the evaporator of the First stage, said temperature typically being the coldest temperature. In addition, a further temperature sensor 608 is provided which measures the temperature within the connecting lead 332, i.e. at the exit of the condenser of the first stage, which is designated by 224 in other figures. Moreover, the temperature sensor 610 measures the temperature at the exit of the evaporator of the second stage 300 i.e. at the exit 320 of FIG. 3B, for example.

Finally, the temperature sensor 612 measures the temperature at the exit 324 of the liquefier 306 of the second stage 300, said temperature being the warmest temperature within the system during the full-performance mode.

With reference to FIGS. 7C and 7D, the various stages and/or modes of operation of the heat pump system as depicted, e.g., by FIGS. 6A to 6D and as also depicted by the other figures, will be addressed below.

DE 10 2012 208 174 A1 discloses a heat pump comprising a free-cooling mode. In the free-cooling mode, the evaporator inlet is connected to a return flow from the area to be heated. In addition, the liquefier inlet is connected to a return flow from the area to be cooled. By means of the free-cooling mode, a substantial increase in efficiency is achieved, specifically for external temperatures smaller than, e.g., 22° C.

Said free-cooling mode (or FCM) is depicted in line 453 in FIG. 4C and is depicted, in particular, in FIG. 6C. For example, in particular the exit of the cold-side heat exchanger is connected to the entrance into the condenser of the first stage. In addition, the exit from the heat-side heat exchanger 214 is coupled to the evaporator entrance of the first stage, and the entrance into the heat-side heat exchanger 214 is connected to the condenser drain of the second stage 300. However, the second stage is deactivated, so that the condenser drain 338 of FIG. 6C has the same temperature, for example, as the condenser intake 413. Additionally, the evaporator drain 334 of the second stage also has the same temperature as the condenser intake 413 of the second stage, so that the second stage 300 is thermodynamically "short-circuited", as it were. However, even though the compressor motor is deactivated, said stage has working liquid flowing through it. Therefore, the second stage is still used as infrastructure but is deactivated on account of the compressor motor having been switched off.

For example, if one is to switch from the medium-performance mode to the high-performance mode, i.e. from a mode wherein the second stage is deactivated and the first stage is active, to a mode wherein both stages are active, it is advantageous to initially allow the compressor motor to run for a certain time period which is longer, for example, than one minute and advantageously amounts to five minutes, before switching the switch 442 from the switch position shown in FIG. 6B to the switch position shown in FIG. 6A.

A heat pump in accordance with one aspect includes an evaporator comprising an evaporator inlet and an evaporator outlet as well as a liquefier comprising a liquefier inlet and a liquefier outlet. Additionally, a switching means is provided for operating the heat pump in one operating mode or in another operating mode. In the one operating mode, the low-performance mode, the heat pump is completely bridged to the effect that the return flow of the area to be cooled is directly connected to the forward flow of the area to be heated. Additionally, in said bridging mode or low-performance mode, the return flow of the area to be heated is connected to the forward flow of the area to be cooled. Typically, the evaporator is associated with the area to be cooled, and the liquefier is associated with the area to be heated.

However, in the bridging mode, the evaporator is not, connected to the area to be cooled, and the liquefier is not connected to the area to be heated, but both areas are "short-circuited", as it were. However, in a second alternative operating mode, the heat pump is not bridged but is typically operated in the free-cooling mode at still relatively low temperatures or is operated in the normal mode with one or two stages. In the free-cooling mode, the switching moans is configured to connect a return flow of the area to be cooled to the liquefier inlet and to connect a return flow of the area to be heated to the evaporator inlet. By contrast, in the normal mode the switching means is configured to connect the return flow of the area to be cooled to the evaporator inlet and to connect the return flow of the area to be heated to the liquefier inlet.

Depending on the embodiment, a heat exchanger may be provided at the exit of the heat pump, i.e. on the side of the liquefier, or at the entrance into the heat pump, i.e. on the side of the evaporator; so as to fluidically decouple the inner heat pump cycle from the outer cycle. In this case, the evaporator inlet represents the inlet of the heat exchanger that is coupled to the evaporator. Moreover, in this case the evaporator outlet represents the outlet of the heat exchanger, which in turn is firmly coupled to the evaporator.

By analogy therewith, on the liquefier side, the liquefier outlet is a heat exchanger outlet, and the liquefier inlet is a heat exchanger inlet, specifically on that side of the heat exchanger which is not firmly coupled to the actual liquefier.

Alternatively, however, the heat pump may be operated without any in or output-side heat exchanger, in this case, one heat exchanger, respectively, might be provided, e.g., at the input into the area to be cooled or at the input into the area to be heated, which heat exchanger will then include the return flow from and/or the forward flow to the area to be cooled or the area to be heated.

In advantageous embodiments, the heat pump is used for cooling, so that the area to be cooled is, e.g., a room of a building, a computer room or, generally, a cold room, whereas the area to be heated is, e.g., a roof of a building or a similar location where a heat-dissipation device may be placed so as to dissipate heat to the environment. However, if as an alternative to the former case, the heat pump is used for heating, the area to be cooled will be the environment from which energy is to be withdrawn, and the area to be heated will be the "useful application", i.e., for example, the interior of a building, of a house or of a room that is to be brought to or kept at a specific temperature.

Thus, the heat pump is capable of switching from the bridging mode either to the free-cooling mode or, if no such free-cooling mode is configured, to the normal mode.

Generally, the heat pump is advantageous in that it becomes particularly efficient in the event of external temperatures smaller than, e.g., 16° C., which is frequently the case at least in locations of the Northern and Southern hemispheres that are at a large distance from the equator.

In this manner one achieves that in the event of external temperatures at which direct cooling is possible, the heat pump may be completely put out of operation. In the event of a heat pump having a centrifugal compressor arranged between the evaporator and the liquefier, the impeller wheel may be stopped, and no more energy needs to be input into the heat pump. Alternatively, however, the heat pump may still run in a standby mode or the like, which, however, due to its nature of being a standby mode only involves a small amount of current consumption. In particular with valveless heat pumps as are advantageously employed, a heat short-circuit may be avoided, in contrast to the free-cooling mode, by fully bridging the heat pump.

In addition, it is advantageous for the switching means to completely disconnect, in the first mode of operation, i.e. in the low-performance or bridging mode, the return flow of the area to be cooled or the forward flow of the area to be cooled from the evaporator so that no liquid connection exists any longer between the inlet and/or the outlet of the evaporator and the area to be cooled. Said complete disconnection will be advantageous on the liquefier side as well.

In implementations, a temperature sensor means is provided which senses a first temperature with regard to the evaporator or a second temperature with regard to the liquefier. In addition, the heat pump comprises a controller coupled to the temperature sensor means and configured to control the switching means as a function of one or more temperatures sensed within the heat pump, so that the switching means switches from the first to the second mode of operation, or vice versa. Implementation of the switching means may be effected by an input switch and an output switch, which comprise four inputs and four outputs, respectively, and are switchable as a function of the mode. Alternatively, however, the switching means may also be implemented by several individual cascaded change-over switches, each of which comprises an input and two outputs.

In addition, the coupling element for coupling the bridging line to the forward flow into the area to be heated or the coupler for coupling the bridging line to the forward flow into the area to be cooled may be implemented as a simple three-connection combination, i.e., as a liquid adder. However, in implementations it is advantageous, in order to obtain optimum decoupling, to configure the couplers also as change-over switches and/or as being integrated into the input switch and/or output switch.

Moreover, a first temperature sensor on the evaporator side is used as the specific temperature sensor, and a second temperature sensor on the liquefier side is used as the second temperature sensor, an all the more direct measurement being advantageous. The evaporator-side measurement is used, in particular, for controlling the speed of the temperature raiser, e.g., of a compressor of the first and/or second stage(s), whereas the liquefier-side measurement or also a measurement of the ambient temperature is employed for performing mode control, i.e., to switch the heat pump from, e.g., the bridging mode to the free-cooling mode, when a temperature is no longer within the very cold temperature range but within the temperature range of medium coldness. However, if the temperature is higher, i.e., within a warm temperature range, the switching means will bring the heat pump into a normal mode with a first active stage or with two active stages.

With a two-stage heat pump, however, in said normal mode, which corresponds to the medium-performance mode, only one first stage will be active, whereas the second stage is still inactive, i.e., is not supplied with current and therefore involves no energy. Not until the temperature rises further, specifically to a very warm range, a second pressure stage will be activated in addition to the first heat pump stage or in addition to the first pressure stage, which second pressure stage in turn will comprise an evaporator, a temperature raiser, typically in the form of a centrifugal compressor, and a liquefier. The second pressure stage may be connected to the first pressure stage in series or in parallel or in series/in parallel.

In order to ensure that in the bridging mode, i.e., when the outside temperatures are already relatively cold, the cold from outside will not fully enter into the heat pump system and, beyond same, into the room to be cooled, i.e., will render the area to be cooled even colder than it actually should be, it is advantageous to provide, by means of a sensor signal, a control signal at the forward flow into the area to be cooled or at the return flow of the area to be cooled, which control signal may be used by a heat dissipation device mounted outside the heat pump so as to control the dissipation of heat, i.e., to reduce the dissipation of heat when the temperatures become too cold. The heat dissipation device is, e.g., a liquid/air heat exchanger, comprising a pump for circulating the liquid introduced into the area to be heated. In addition, the heat dissipation device may have a ventilator so as to transport air into the air heat exchanger. Additionally or alternatively, a three-way mixer may also be provided so as to partly or fully short-circuit the air heat exchanger. Depending on the forward flow into the area to be cooled, which in this bridging mode is not connected to the evaporator outlet, however, but to the return flow from the area to be heated, the heat dissipation device, i.e., the pump, the Ventilator or the three-way mixer, for example, is controlled to continuously reduce the dissipation of heat in order to maintain a temperature level, specifically within the heat pump system and within the area to be cooled, which in this case may be above the level of the outside temperature. Thus, the waste heat may even be used for heating the room "to be cooled" when the outside temperatures are too cold.

In a further aspect, total control of the heat pump is effected such that, depending on a temperature sensor output signal of a temperature sensor on the evaporator side, "fine control" of the heat pump is effected, i.e., a speed control in the various modes, i.e., e.g., in the free-cooling mode, the normal mode having the first stage and the normal mode having the second stage, and also control of the heat dissipation device in the bridging mode, whereas mode switching is effected as coarse control by means of a temperature sensor output signal of a temperature sensor on the liquefier side. Thus, switching of the mode of operation from the bridging mode (or LPM) to the free-cooling mode (or FCM) and/or into the normal mode (MPM or HPM) is performed merely on the basis of a liquefier-side temperature sensor; the evaporator-side temperature output signal is not taken into account in the decision whether switching takes place or not. However, for speed control of the centrifugal compressor and/or for controlling the heat dissipation devices, it is again only the evaporator-side temperature output signal that is used rather than the liquefier-side sensor output signal.

It shall be noted that the various aspects of the present invention with regard to the arrangement and the two-stage system as well as with regard to utilization of the bridging mode, control of the heat dissipation device in the bridging mode or free-cooling mode, or control of the centrifugal compressor in the free-cooling mode or the normal mode of operation, or with regard to utilization of two sensors, one sensor being used for switching the mode of operation and the other sensor being used for fine control, may be employed irrespective of one another. However, said aspects may also be combined in pairs or in larger groups or even with one another.

FIGS. 7A to 7D show overviews of various modes wherein the heat pump of FIG. 1, FIG. 2, FIGS. 8A, 9A may be operated. If the temperature of the area to be heated is very cold, e.g. less than 16° C., the operating mode selection will activate the first operating mode wherein the heat pump is bridged and the control signal 36*b* for the heat dissipation device is generated in the area 16 to be heated. If the temperature of the area to be heated, i.e., of the area 16 of FIG. 1, is within a medium-cold temperature range, i.e., within a range between 16° C. and 22° C., the operating mode controller will activate the free-cooling mode, wherein the first stage of the heat pump may operate at low power due to the small temperature spread. However, if the temperature of the area to be heated is within a warm temperature range, i.e., e.g., between 22° C. and 28° C., the heat pump will be operated in the normal mode, however, in the normal mode with a first heat pump stage. If, however, the outside temperature is very warm, i.e., within a temperature range from 28° C. to 40° C., a second heat pump stage will be activated which also operates in the normal mode and which supports the first stage which is already running.

Advantageously, speed control and/or "fine control" of a centrifugal compressor is effected, within the temperature raiser 34 of FIG. 1 within the temperature ranges of "medium cold", "warm", "very warm" so as to operate the heat pump only ever at that heating/cooling capacity that may currently be called for by the actually present conditions.

Advantageously, mode switching is controlled by a liquefier-side temperature sensor, whereas fine control and/or the control signal for the first mode of operation depend on an evaporator-side temperature.

It shall be noted that the temperature ranges of "very cold", "medium cold", "warm", "very warm" represent different temperature ranges whose respectively average temperatures increase from very cold to medium cold to warm to very warm. As is depicted by FIG. 7C, the ranges may directly adjoin one another. However, in embodiments, the ranges may also overlap and be at the mentioned temperature level or at a different temperature level, which may be higher or lower in total. Moreover, the heat pump is advantageously operated with water as the working medium. Depending on the requirement, however, other means may also be employed.

This is depicted in a tabular manner in FIG. 7D. If the liquefier temperature lies within a very cold temperature range, the controller 430 will react by setting the first mode of operation. If it is found in this mode that the evaporator temperature is lower than a target temperature, a reduction in the thermal output is achieved by a control signal at the heat dissipation device. However, if the liquefier temperature is within the medium-cold range, the controller 430 may be expected to react thereto by switching to the free-cooling mode, as is shown by lines 431 and 434. If the evaporator temperature here exceeds a target temperature, this will result in an increase in the speed of the centrifugal compressor of the compressor via the control line 434. If it is found, in turn, that the liquefier temperature is within a warm temperature range, the first stage will be put into normal operation as a reaction thereto, which is performed by a signal on the line 434. If it is found, in turn, that given a specific speed of the compressor, the evaporator temperature still exceeds a target temperature, this will result, as a reaction thereto, in an increase in the speed of the first stage again via the control signal on the line 434. If it is eventually found that the liquefier temperature is within a very warm temperature range, a second stage will be additionally switched on during normal operation as a reaction thereto, which again is effected by a signal on the line 434. Depending on whether the evaporator temperature is higher or lower than a target temperature, as is signaled by the signals on the line 432, control of the first and/or second stage is performed so as to react to a changed situation.

In this manner, transparent and efficient control achieved which, on the one hand, achieves "coarse tuning" due to the mode switching, and on the other hand achieves "fine tuning" on account of temperature-dependent speed adjustment, to the effect that only so much energy needs to be consumed at any point in time as is actually currently called for. Said approach, which does not involve continuous turn-on and turn-off operations in a heat pump, such as with known heat pumps comprising hysteresis, for example, also ensures that no starting losses arise due to continuous operation.

Advantageously, speed control and/or "fine control" of a centrifugal compressor within the compressor motor of FIG. 1 is effected within the temperature ranges of "medium cold", "warm", "very warm" so as to operate the heat pump only with that thermal performance/refrigerating capacity that is currently called for by the actually present conditions.

Advantageously, mode switching is controlled by a liquefier-side temperature sensor, whereas fine control and/or the control signal for the first operating mode depend on an evaporator-side temperature.

In the event of mode switching, the controller 430 is configured to sense a condition for transition from the medium-performance mode to the high-performance mode. Then the compressor 304 is started in the further heat pump stage 300. It is not until a predetermined time period, which is longer than one minute and advantageously even longer than four or even five minutes, has expired that the controllable way module is switched from the medium-performance mode to the high-performance mode. In this manner, it is achieved that switching may be simply performed from a resting position; allowing the compressor motor to run prior to switching ensures that the pressure within the evaporator becomes smaller than the pressure within the compressor.

It shall be noted that the temperature ranges in FIG. 7C may be varied. In particular, the threshold temperatures, between a very cold temperature and a medium-cold temperature, i.e., the value 16° C. in FIG. 7C, as well as between the medium-cold temperature and the warm temperature, i.e., the value of 22° C. in FIG. 7C, and the value between the warm and the very warm temperature, i.e. the value of 28° C. in FIG. 7C, are only exemplarily. Advantageously, the threshold temperature ranging between warm and very warm, at which switching from the medium-performance mode to the high-performance mode takes place, amounts to from 25 to 30° C. In addition, the threshold temperature ranging between warm and medium cold, i.e., when switching takes place between the free-cooling mode and the medium-performance mode, lies within a temperature range from 18 to 24° C. Eventually, the threshold temperature at which switching is performed between the medium cold mode and the very cold mode ranges from 12 to 20° C.; the values are advantageously selected as shown in the table of FIG. 7C but may be set differently within the ranges mentioned, as was said before.

However, depending on the implementation and the requirement profile, the heat pump system may also be operated in four modes of operation, which also differ from one another but are all at different absolute levels, so that the designations "very cold", "medium cold", "warm", "very warm" are to be understood only in relation to one another but are not to represent any absolute temperature values.

Even though specific elements are described as device elements, it shall be noted that said description may be equally regarded as a description of steps of a method, and vice versa. For example, the block diagrams described in FIGS. 6A to 6D similarly represent flowcharts of a corresponding inventive method.

In addition, it shall be noted that the controller may be implemented, e.g., as hardware or as software by the element 430 in FIG. 4B, which also applies to the tables in FIG. 4C, 4D or 7A, 7B, 7C, 7D. The controller may be implemented on a non-volatile storage medium, a digital or other storage medium, in particular a disc or CD comprising electronically readable control signals which may cooperate with a programmable computer system such that the corresponding method of pumping heat and/or of operating a heat pump is performed. Generally, the invention thus also includes a computer program product comprising a program code, stored on a machine-readable carrier, for performing the method when the computer program product runs on a computer. In other words, the invention may thus be also implemented as a computer program having a program code for performing the method when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including a such alterations, permutations and equivalents as fall within the true spirit and scope of the present invention.

The invention claimed is:

1. A heat pump system comprising:

a heat pump stage comprising a first evaporator, a first liquefier, and a first compressor; and a further heat pump stage comprising a second evaporator, a second liquefier, and a second compressor, wherein a first liquefier exit of the first liquefier is connected to an evaporator entrance of the second evaporator via a connecting lead, so that during operation of the heat pump system, working liquid from the first liquefier of the heat pump stage enters into the second evaporator of the further heat pump stage via the connecting lead and evaporates within the second evaporator of the further heat pump stage to obtain evaporated working liquid in the second evaporator, wherein the heat pump stage and the further heat pump stage are connected to operate in a cascade connection, and wherein the heat pump stage and the further heat pump stage are connected so that the evaporated working liquid in the second evaporator is compressed by the second compressor of the further heat pump stage.

2. The heat pump system as claimed in claim 1, wherein the first liquefier of the heat pump stage is arranged in an operating position above the second evaporator of the further heat pump stage, so that the working liquid flows, within the connecting lead, from the first liquefier into the second evaporator due to gravity, or wherein the connecting lead is continuous and comprises no pump or valve.

3. The heat pump system as claimed in claim 1, further comprising:

a first heat exchanger on a side to be cooled;

a second heat exchanger on a side to be heated;

a first pump coupled to the first heat exchanger, a second pump coupled to the second heat exchanger; and an intermediate-circuit pump which is connected, on its suction side, to a second evaporator exit of the further heat pump stage.

4. The heat pump system as claimed in claim 3, wherein the first pump, the second pump or the intermediate-circuit pump are arranged below the heat pump stage or the further heat pump stage, or wherein the first heat exchanger or the second heat exchanger is arranged next to the first pump, the second pump or the intermediate-circuit pump.

5. The heat pump system as claimed in claim 3, wherein the heat pump system is configured such that at least one outlet of an evaporator or liquefier of a heat pump stage that is connected to the first heat exchanger or to the second heat exchanger is arranged to exit from the heat pump stage, in the operating position, in a manner that is perpendicularly downward or at an angle smaller than 45° from a vertical line from the heat pump stage, or wherein the heat pump system is configured such that at least one inlet of an evaporator or liquefier of a heat pump stage that is connected to the first heat exchanger or to the second heat exchanger is configured to exit from the heat pump stage, in the operating position, in a manner that is perpendicularly downward or at an angle smaller than 45° from a vertical line from the heat pump stage.

6. The heat pump system as claimed in claim 1, wherein the heat pump stage or the further heat pump stage comprises an expansion element so as to direct working liquid from a respective liquefier into the respective evaporator, wherein the expansion element within the heat pump stage and the further heat pump stage is configured as an expansion overflow arrangement so as to direct working liquid into the respective evaporator when a predetermined level within a respective liquefier is exceeded.

7. The heat pump system as claimed in claim 1, which further comprises:

a first pump which is coupled, on its suction side, to a first evaporator drain of the first heat pump stage;

an overflow arrangement within the second evaporator which is configured to lead off working liquid into the second evaporator as of a predefined maximum level of working liquid;

a liquid line which is coupled to the overflow arrangement, on the one hand, and is coupled to the suction side of the first pump at a coupling point, on the other hand, a pressure reducer being present at said coupling point.

8. The heat pump system as claimed in claim 1, wherein the heat pump stage is configured such that a vapor suction channel extends through the liquefier, or wherein the heat pump stage is configured such that the compressor extends above the liquefier, so that in an off state of the compressor, liquid flows away from the compressor due to gravity, or which is configured to use water as the working medium, the at least one heat pump stage being configured to maintain a pressure at which the water can evaporate at temperatures below 60° C.

9. The heat pump system as claimed in claim 1, wherein an evaporator exit of the heat pump stage is connected to a suction side of the first pump via a first downpipe, the downpipe being perpendicular or comprising an angle of a maximum of 45° in relation to a vertical when in the operating position, or wherein a liquefier exit of the further heat pump stage is connected to a suction side of the second pump via a second downpipe, the downpipe being perpendicular or comprising an angle of a maximum of 45° in relation to a vertical when in the operating position.

10. The heat pump system as claimed in claim 1, wherein a liquefier exit of the heat pump stage is connected to an evaporator entrance of the further heat pump stage by an intermediate-circuit pipe, the intermediate-circuit pipe having no pump arranged therein, and wherein the heat pump stage and the further heat pump stage are configured and arranged such that during the operation of the heat pump system, a liquefier working liquid level of the heat pump stage is higher than an evaporator working liquid level within the further heat pump stage, or further comprising an intermediate-circuit pump which is arranged below the heat pump stage and the further heat pump stage and is connected to an evaporator exit of the further heat pump stage via a downpipe connected to a suction side of the intermediate-circuit pump, or wherein the heat pump stage and the further heat pump stage each comprise a compressor arranged above a respective condenser, and wherein the heat pump stage and the further heat pump stage are mutually arranged such that a radial impeller of the second compressor is arranged to be at least 5 cm lower than a radial impeller of the first compressor, or wherein the heat pump stage and the further heat pump stage have outer housing dimensions which are identical within a tolerance range of 5 cm, the housing of the heat pump stage being arranged to be higher than the housing of the further heat pump stage, so that a lower side of the housing of the heat pump stage is higher than a lower side of the housing of the further heat pump stage.

11. The heat pump system as claimed in claim 10, wherein a controllable way module is arranged below the heat pump stage and above the first pump, the second pump or the intermediate-circuit pump so as to connect at least two inputs into the way module to at least two outputs from the way module.

12. The heat pump system as claimed in claim 11, wherein the controllable way module comprises the following connections:

a return flow from a first heat exchanger as a first input;

a return flow from a second heat exchanger as a second input;

a pumping side of an intermediate-circuit pump as a third input;

an intake leading into the evaporator of the heat pump stage as a first output;

an intake into the liquefier of the heat pump stage as a second output; and an intake leading into the liquefier of the further heat pump stage as a third output, and wherein the controllable way module is configured to connect one or more inputs to one or more outputs as a function of a control signal.

13. The heat pump system as claimed in claim 11, further comprising a controller to control the heat pump system and the controllable way module to operate the heat pump system in one of at least two different modes, the heat pump system being configured to perform at least two modes selected from a group of modes comprising the following modes:

a high-performance mode in which the heat pump stage and the further heat pump stage are active;

a medium-performance mode in which the heat pump stage is active and the further heat pump stage is inactive;

a free-cooling mode in which the heat pump stage is active and the further heat pump stage is inactive and a second heat exchanger is coupled to an evaporator inlet of the heat pump stage; and a low-performance mode in which the heat pump stage and the further heat pump stage are inactive.

14. The heat pump system as claimed in claim 13, wherein the heat pump stage or the further heat pump stage will be inactive when a compressor motor of the corresponding heat pump stage is turned off.

15. The heat pump system as claimed in claim 13, wherein in the high-performance mode and in the medium-performance mode and in the free-cooling mode, the first pump, the second pump and the intermediate-circuit pump are active, and wherein in the low-performance mode, the first pump and the second pump are active and the intermediate-circuit pump is inactive.

16. The heat pump system as claimed in claim 11, wherein the controllable way module is configured, in a high-performance mode, to connect the first input to the first output, to connect the second input to a third output, and to connect the third input to the second output, in a medium-performance mode, to connect the first input to the first output, to connect the second input to the second output, and to connect the third input to the third output, in a free-cooling mode, to connect the first input to the second output, to connect the second input to the first output, and to connect the third input to the third output, and in a low-performance mode, to connect the first input to the third output, to connect the second input to the first output, and to connect the third input to the second output.

17. The heat pump system as claimed in claim 11, wherein the controllable way module comprises a first change-over switch comprising two switch positions, and a second change-over switch comprising two switch positions, an output of the first switch being connected to an input of the second switch, or wherein the respectively two switch positions define four modes of operation comprising different performance stages, wherein during change-over from one performance stage to a performance stage that is one level up or one level down, only one change-over switch is switched in each case and the other change-over switch remains in its position.

18. The heat pump system as claimed in claim 1, further comprising:

a first pump coupled to a first heat exchanger, a second pump coupled to a second heat exchanger, and a controllable way module, wherein the heat pump stage, the further heat pump stage, the first pump, the second pump and the controllable way module are coupled to one another such that in an operating mode in which the heat pump stage or the further heat pump stage is inactive, the evaporator or liquefier of the inactive heat pump stage has a working liquid flowing through it due to an activity of the first pump or the second pump.

19. The heat pump system as claimed in claim 1, wherein the first evaporator of the heat pump stage comprises a first evaporator entrance, a first evaporator exit, and a first vapor channel connected to the first compressor.

20. The heat pump system as claimed in claim 1, wherein the second evaporator comprises the evaporator entrance, a second evaporator exit, and a second vapor channel connected to the second compressor, wherein the heat pump system is configured so that, in the operation of the heat pump system, the evaporated working liquid in the second evaporator moves to the second compressor via the second vapor channel.

21. The heat pump system as claimed in claim 20, wherein the second evaporator exit is connected to a first liquefier inlet by a further connecting lead so that, in the operation of the heat pump system, working liquid leaving the second evaporator exit enters into first liquefier inlet.

22. The heat pump system as claimed in claim 1, configured to achieve a total temperature spread, wherein, in the cascade connection, the total temperature spread is subdivided into a first temperature spread achieved by the heat pump stage and a second temperature spread achieved by the further heat pump stage.

23. The heat pump system as claimed in claim 1, wherein the first compressor is connected to the first liquefier via a first vapor feed channel, wherein the second compressor is connected to the second liquefier via a second vapor feed channel, wherein the first liquefier has, in addition to the first vapor feed channel, a first liquefier inlet, and the first liquefier exit, and wherein the second liquefier has, in addition to the second vapor feed channel, a second liquefier inlet, and a second liquefier exit.

24. A method of configuring a heat pump system comprising a heat pump stage comprising a first evaporator, a first liquefier, and a first compressor, and a further heat pump stage comprising a second evaporator, a second liquefier, and a second compressor, comprising:

connecting a first liquefier exit of the first liquefier is connected to an evaporator entrance of the second evaporator, so that during operation of the heat pump system, working liquid from the first liquefier of the heat pump stage enters into the second evaporator of the further heat pump stage via the connecting lead and evaporates within the second evaporator of the further heat pump stage to obtain evaporated working liquid in the second evaporator, wherein the heat pump stage and the further heat pump stage are connected to operate in a cascade connection, and wherein the heat pump stage and the further heat pump stage are connected so that the evaporated working liquid in the second evaporator is compressed by the second compressor of the further heat pump stage.

25. A method of operating a heat pump system comprising a heat pump stage comprising a first evaporator, a first liquefier, and a first compressor, and a further heat pump stage comprising a second evaporator, a second liquefier, and a second compressor, wherein a first liquefier exit of the first liquefier is connected to an evaporator entrance of the second evaporator via a connecting lead, comprising:

directing a working liquid from the first liquefier exit of the first liquefier to the evaporator entrance of the second evaporator through the connecting lead, so that during operation of the heat pump system, working liquid from the first liquefier of the heat pump stage enters into the second evaporator of the further heat pump stage via the connecting lead and evaporates within the second evaporator of the further heat pump stage to obtain evaporated working liquid in the second evaporator, wherein the heat pump stage and the further heat pump stage are connected to operate in a cascade connection, and wherein the heat pump stage and the further heat pump stage are connected so that the evaporated working liquid in the second evaporator is compressed by the second compressor of the further heat pump stage.

* * * * *